US010042287B2

(12) United States Patent
Mimura et al.

(10) Patent No.: US 10,042,287 B2
(45) Date of Patent: Aug. 7, 2018

(54) IMAGE FORMING APPARATUS AND TONER CASE

(71) Applicant: KYOCERA Document Solutions Inc., Osaka (JP)

(72) Inventors: Daisuke Mimura, Osaka (JP); Tomohiro Watatani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/835,684

(22) Filed: Dec. 8, 2017

(65) Prior Publication Data

US 2018/0164715 A1 Jun. 14, 2018

(30) Foreign Application Priority Data

Dec. 9, 2016 (JP) ..... 2016-239511

(51) Int. Cl.
*G03G 15/08* (2006.01)

(52) U.S. Cl.
CPC ..... *G03G 15/0887* (2013.01); *G03G 15/0832* (2013.01); *G03G 15/0875* (2013.01); *G03G 15/0886* (2013.01)

(58) Field of Classification Search
USPC ..... 399/119, 120, 252, 254–256, 258, 262, 399/263
See application file for complete search history.

(56) References Cited

U.S. PATENT DOCUMENTS 9,031,477 B2 * 5/2015 Ishii ..... G03G 15/0865 399/263
9,182,703 B1 * 11/2015 Sato ..... G03G 15/0868
9,513,576 B2 * 12/2016 Kikuchi ..... G03G 15/0872
9,529,303 B2 * 12/2016 Mitsuishi ..... G03G 15/0867

FOREIGN PATENT DOCUMENTS

JP 2001-305841 A 11/2001
JP 2009175760 * 8/2009

* cited by examiner

*Primary Examiner* — Hoan Tran
(74) *Attorney, Agent, or Firm* — Studebaker & Brackett PC

(57) ABSTRACT

An image forming apparatus includes a toner case and an attachment part. The toner case includes a case main body, a rotator, a transmitter and a moving mechanism. The rotator rotates around a rotation axis. At least apart of the rotator is stored in the case main body. The transmitter is arranged outside the case main body and has a transmitting coupling. The attachment part includes a manipulation member and a driving coupling. As the manipulation member moves from a first manipulating position to a second manipulating position in a state where the toner case is attached to the attachment part, the moving mechanism moves the transmitter from a first position to a second position which is arranged at an outside of the first position in a rotation axis direction of the rotator, and the transmitting coupling is coupled to the driving coupling.

13 Claims, 24 Drawing Sheets

IMAGE FORMING APPARATUS AND TONER CASE

INCORPORATION BY REFERENCE

This application is based on and claims the benefit of priority from Japanese patent application No. 2016-239511 filed on Dec. 9, 2016, which is incorporated by reference in its entirety.

BACKGROUND

The present disclosure relates to an image forming apparatus and a toner case detachably attached to an attachment part of the image forming apparatus.

An image forming apparatus, such as a printer, a copying machine, a facsimile and a multifunctional peripheral, includes a toner case which replenishes a developing device with a toner (a developer). For instance, the toner case includes a case main body storing the toner, a rotator stored in the case main body and rotating around a rotation axis and a transmitter arranged outside the case main body and transmitting rotation to the rotator. In such a toner case, by transmitting the rotation from the transmitter to the rotator, the toner in the case main body is agitated or conveyed by the rotator.

The above toner case is usually detachably attached to an attachment part provided at the image forming apparatus. The above attachment part includes a driving coupling rotated by rotation driving force from a driving source. By coupling the driving coupling to a transmitting coupling of the transmitter, it becomes possible to transmit the rotation driving force from the driving source to the transmitter.

SUMMARY

In accordance with an aspect of the present disclosure, an image forming apparatus includes a toner case and an attachment part to which the toner case is detachably attached. The toner case includes a case main body, a rotator, a transmitter and a moving mechanism. The case main body stores a toner. The rotator rotates around a rotation axis. At least a part of the rotator is stored in the case main body. The transmitter is arranged outside the case main body, has a transmitting coupling and transmits rotation to the rotator. The moving mechanism moves the transmitter between a first position and a second position which is arranged at an outside of the first position in a rotation axis direction of the rotator. The attachment part includes a manipulation member and a driving coupling. The manipulation member moves between a first manipulating position and a second manipulating position. The driving coupling rotates by rotation driving force from a driving source. As the toner case is attached to the attachment part, the moving mechanism engages with the manipulation member and the transmitting coupling faces the driving coupling. As the manipulation member moves from the first manipulating position to the second manipulating position in a state where the toner case is attached to the attachment part, the moving mechanism moves the transmitter from the first position to the second position and the transmitting coupling is coupled to the driving coupling.

In accordance with an aspect of the present disclosure, a toner case is detachably attached to an attachment part of an image forming apparatus. The toner case includes a case main body, a rotator, a transmitter and a moving mechanism. The case main body stores a toner. The rotator rotates around a rotation axis. At least a part of the rotator is stored in the case main body. The transmitter is arranged outside the case main body, has a transmitting coupling and transmits rotation to the rotator. The moving mechanism moves the transmitter between a first position and a second position which is arranged at an outside of the first position in a rotation axis direction of the rotator. The attachment part includes a manipulation member and a driving coupling. The manipulation member moves between a first manipulating position and a second manipulating position. The driving coupling rotates by rotation driving force from a driving source. As the toner case is attached to the attachment part, the moving mechanism engages with the manipulation member and the transmitting coupling faces the driving coupling. As the manipulation member moves from the first manipulating position to the second manipulating position in a state where the toner case is attached to the attachment part, the moving mechanism moves the transmitter from the first position to the second position and the transmitting coupling is coupled to the driving coupling.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A First Embodiment

Hereinafter, a first embodiment of the present disclosure will be described with reference to FIG. 1 to FIG. 17.

Figure 1:
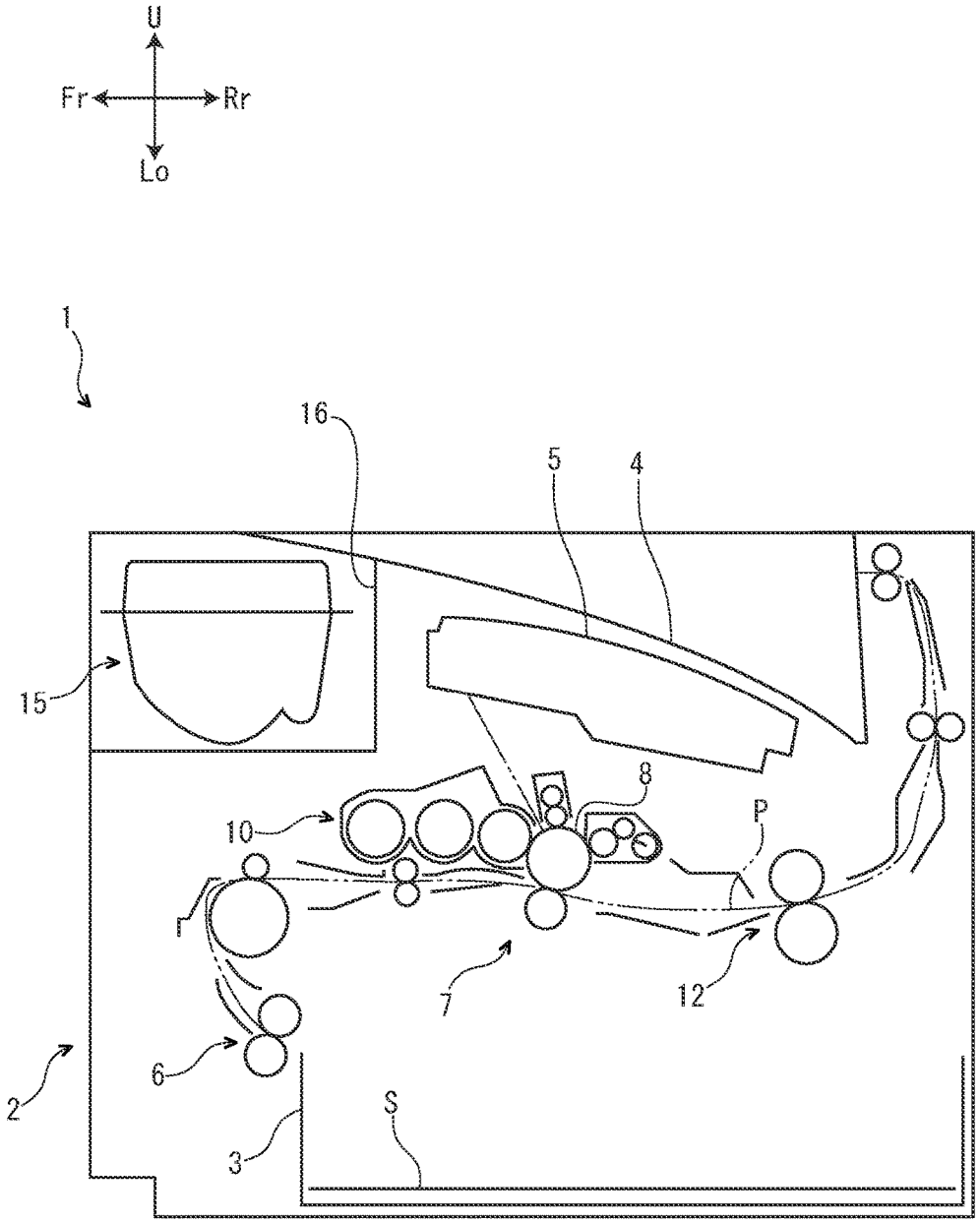
FIG. 1 is a schematic view showing a printer according to a first embodiment of the present disclosure.

Firstly, an entire structure of a printer 1 (an example of an image forming apparatus) will be described. In the following description, for convenience of explanation, a left side on FIG. 1 is defined to be a front side of the printer 1. Arrows Fr, Rr, L, R, U and Lo shown in each figure respectively indicate a front side, a rear side, a left side, a right side, an upper side and a lower side of the printer 1.

With reference to FIG. 1, the printer 1 includes a box-shaped printer main body 2 (an example of an apparatus main body). In a lower portion of the printer main body 2, a sheet feeding cassette 3 storing a sheet S (an example of a recording medium) is stored. On an upper face of the printer main body 2, an ejected sheet tray 4 is provided. In an upper portion of the printer main body 2, an exposing device 5 is stored below the ejected sheet tray 4.

Inside the printer main body 2, a conveying path P for the sheet S is provided. At an upstream end of the conveying path P, a sheet feeding part 6 is provided. At a middle portion of the conveying path P, an image forming part 7 is provided. The image forming part 7 includes a photosensitive drum 8 and a developing device 10. Ata downstream portion of the conveying path P, a fixing device 12 is provided.

In a front upper portion of the printer main body 2, a toner container 15 (an example of a toner case) is stored. The toner container 15 is detachably attached to an attachment part 16.

Next, an operation of the printer 1 having the above described configuration will be described.

Firstly, laser light (refer to a two-dotted line in FIG. 1) emitted from the exposing device 5 exposes the photosensitive drum 8 to form an electrostatic latent image on the photosensitive drum 8. Next, the electrostatic latent image on the photosensitive drum 8 is developed by the developing device 10 to a toner image. Thereby, an image forming operation is finished.

On the other hand, the sheet S fed from the sheet feeding cassette 3 by the sheet feeding part 6 is conveyed to the image forming part 7 synchronously with the above described image forming operation. At the image forming part 7, the above toner image is transferred on the sheet S from the photosensitive drum 8. The sheet S on which the toner image is transferred is conveyed to the downstream side along the conveying path P and enters the fixing device 12. The fixing device 12 fixes the toner image on the sheet S. The sheet S on which the toner image is fixed is ejected on the ejected sheet tray 4 from a downstream end of the conveying path P.

Next, the toner container 15 will be described in detail.

Figure 2:
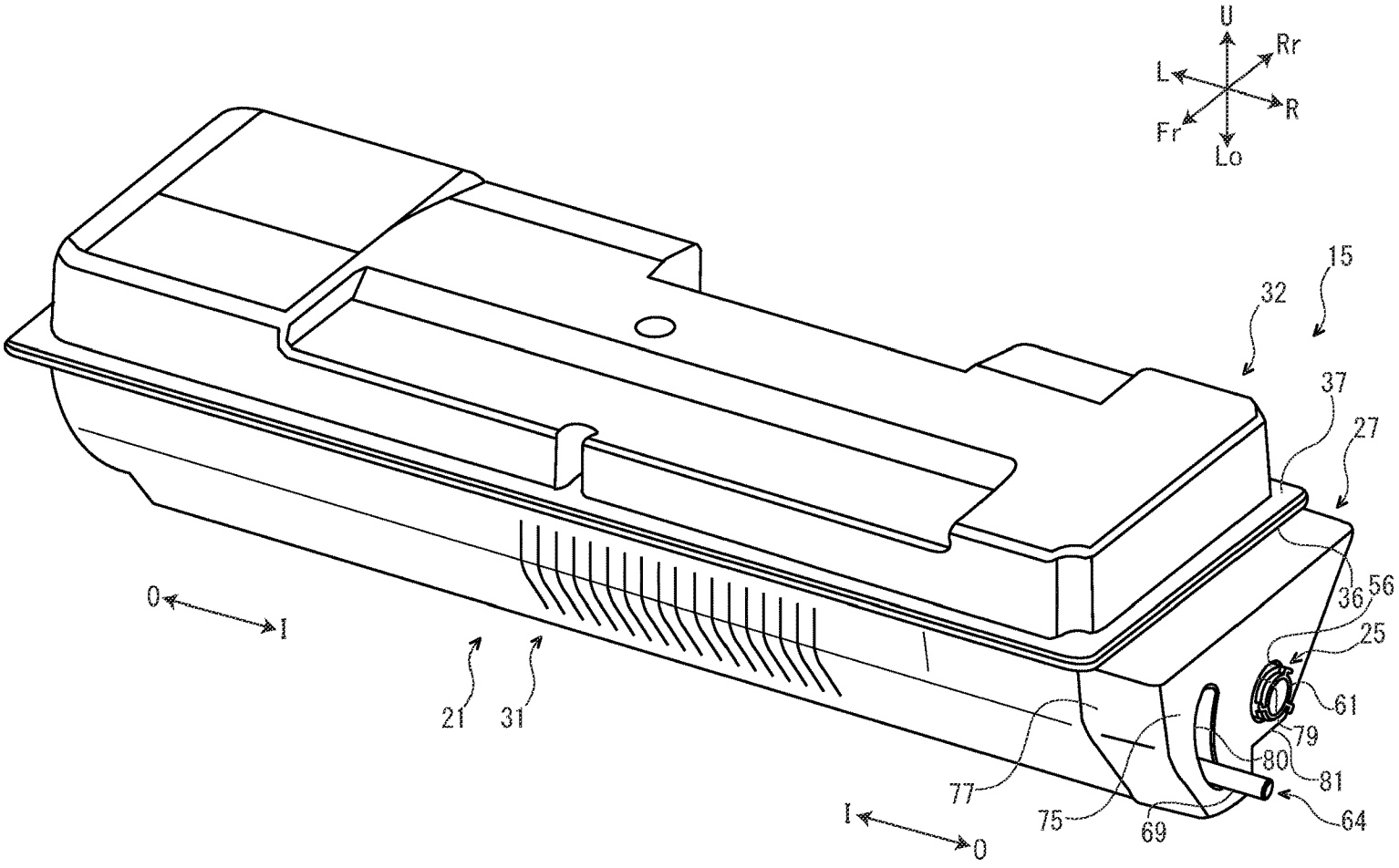
FIG. 2 is a perspective view showing a toner container according to the first embodiment of the present disclosure.

An arrow O shown in each figure after FIG. 2 indicates an outside in the left-and-right direction of the toner container 15, and an arrow I shown in each figure after FIG. 2 indicates an inside in the left-and-right direction of the toner container 15.

Figure 3:
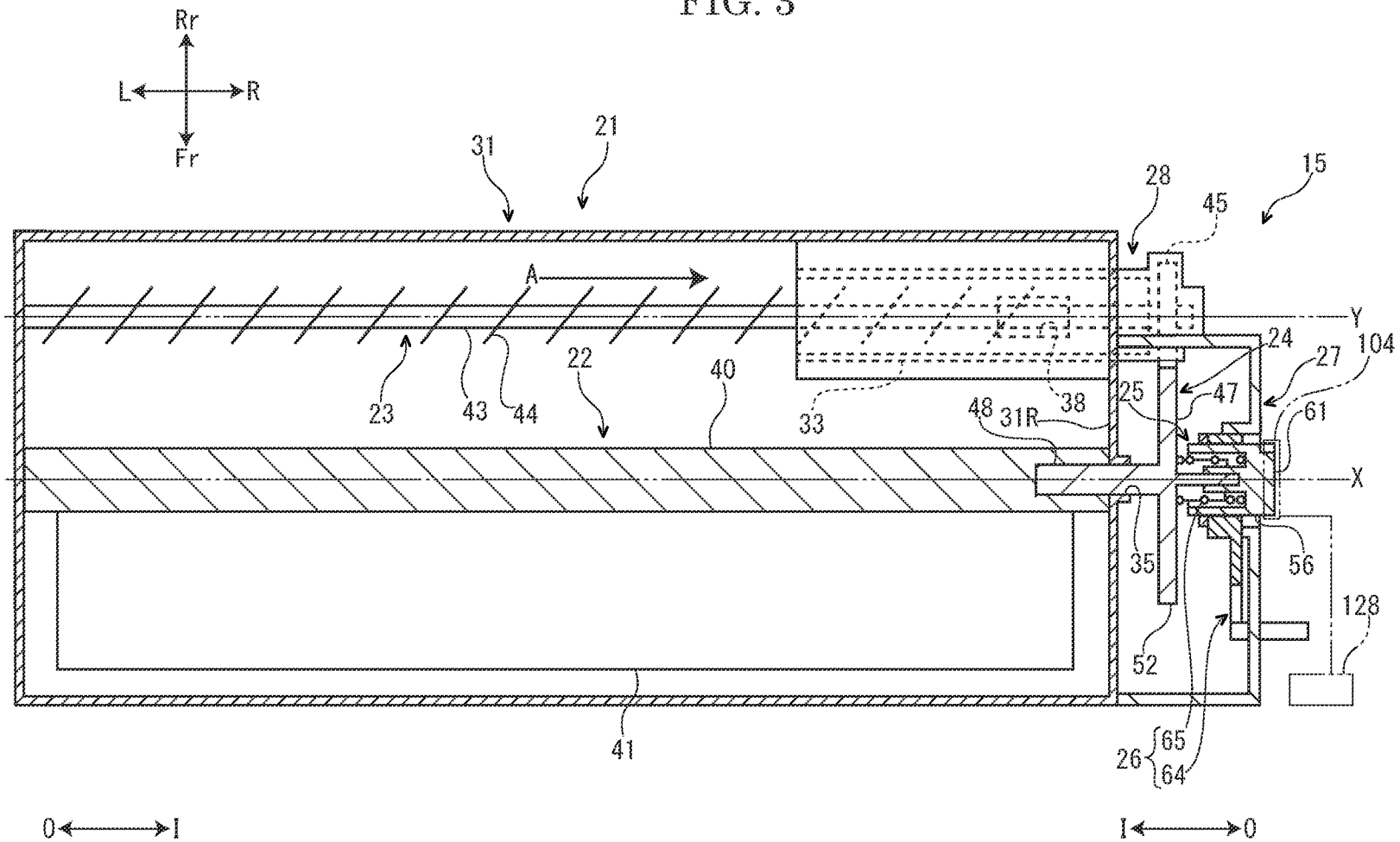
FIG. 3 is a sectional view schematically showing the toner container according to the first embodiment of the present disclosure.

With reference to FIG. 2 and FIG. 3, the toner container 15 includes a case main body 21, an agitator 22 (an example of a rotator) stored in a center portion of the case main body 21, a conveyer 23 (an example of a rotator) stored in a rear lower portion of the case main body 21, a supporter 24 arranged at a right end side of the case main body 21, a transmitter 25 and a moving mechanism 26 which are arranged at a right side (the outside in the left-and-right direction) of the supporter 24, a cover 27 covering a right side (the outside in the left-and-right direction) of the case main body 21 and a shutter 28 arranged at a rear lower side of a right end portion of the case main body 21.

The case main body 21 of the toner container 15 has a shape elongated in the left-and-right direction. The case main body 21 stores a toner (a developer). The case main body 21 includes a storage 31, a lid 32 provided at an upper side of the storage 31 and a duct 33 provided at a rear lower side of a right end portion of the storage 31.

The storage 31 of the case main body 21 is formed in a box-like shape whose upper side is opened. In a center portion of a right side wall 31R of the storage 31, a supporting hole 35 is provided. Around an upper end of an outer circumference of the storage 31, a lower side flange portion 36 is provided.

The lid 32 of the case main body 21 is formed in a box-like shape whose lower side is opened. Around a lower end of an outer circumference of the lid 32, an upper side flange portion 37 is provided. The upper side flange portion 37 is fixed to the lower side flange portion 36 of the storage 31. Thereby, the lid 32 is integrated with the storage 31. An inner space of the lid 32 is communicated with an inner space of the storage 31.

The duct 33 of the case main body 21 is formed in a cylindrical shape extending along the left-and-right direction. The duct 33 is formed integrally with the storage 31. An inner space of the duct 33 is communicated with the inner space of the storage 31. On a lower face of the duct 33, a discharge port 38 through which the toner is discharged is provided.

With reference to FIG. 3, the agitator 22 of the toner container 15 is stored in the storage 31 of the case main body 21. The agitator 22 is rotatable around a first rotation axis X extending along the left-and-right direction. That is, the left-and-right direction is a rotation axis direction of the agitator 22 in the present embodiment. The agitator 22 includes an agitating shaft 40 extending along the left-and-right direction and an agitating blade 41 mounted to the agitating shaft 40. The agitating blade 41 is made of resin film, for example, and formed in a sheet-like shape.

A portion between a left end portion and a center portion in the left-and-right direction of the conveyer 23 of the toner container 15 is stored in the storage 31 of the case main body 21. Aright side portion of the conveyer 23 is stored in the duct 33 of the case main body 21. A right end portion of the conveyer 23 is protruded to the right side (the outside in the left-and-right direction) further than the duct 33, and exposed to an outside of the case main body 21. The conveyer 23 is rotatable around a second rotation axis Y extending along the left-and-right direction. That is, the left-and-right direction is a rotation axis direction of the conveyer 23.

The conveyer 23 includes a conveying shaft 43 extending along the left-and-right direction, a spiral conveying fin 44 protruding on an outer circumference of the conveying shaft 43 and a driven gear 45 fixed to the right end portion (the portion exposed to the outside of the case main body 21) of the conveying shaft 43.

Figure 4:
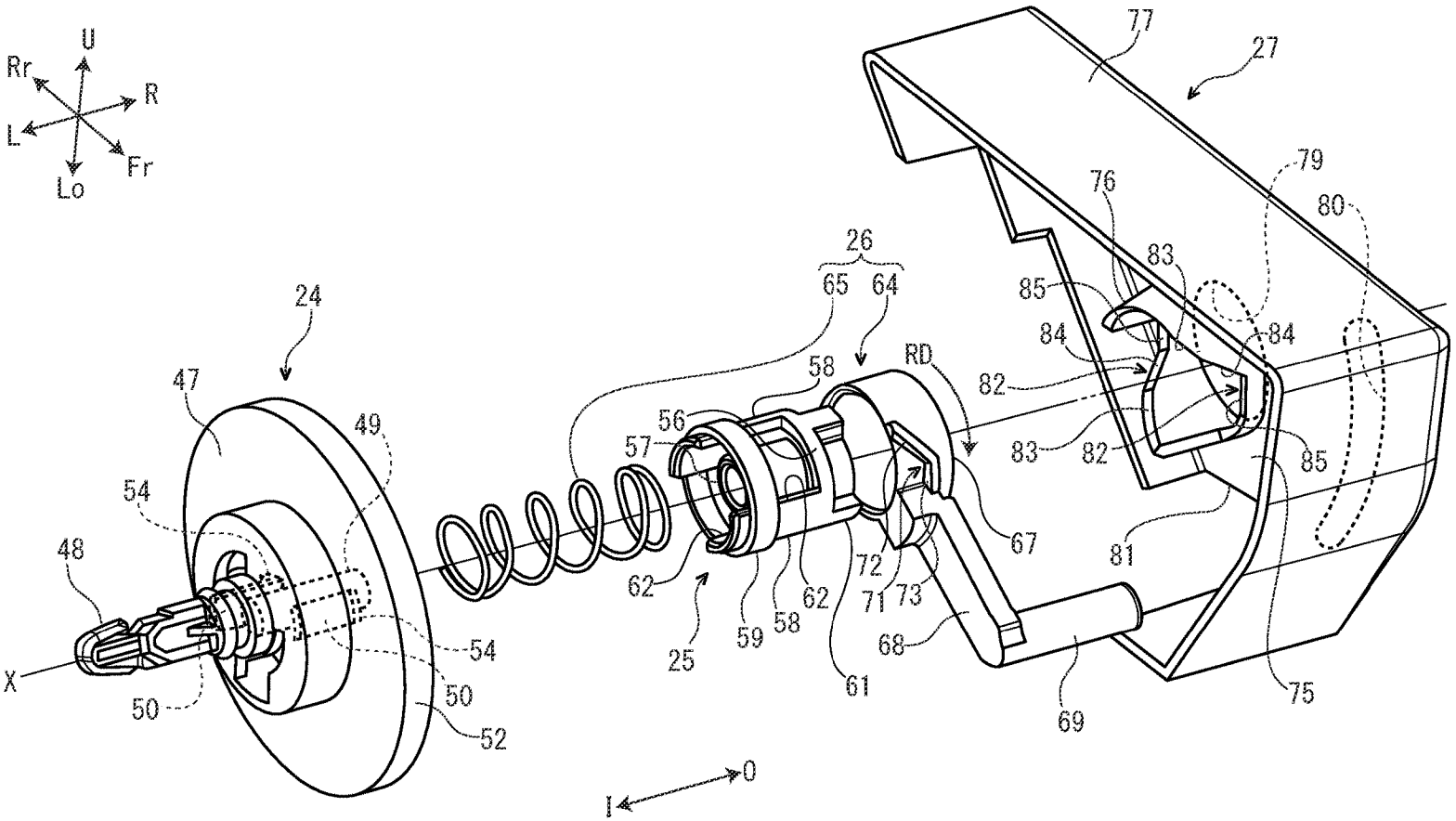
FIG. 4 is a disassembled perspective view showing a supporter, a transmitter, a moving mechanism and a cover, in the toner container according to the first embodiment of the present disclosure.

With reference to FIG. 4, the supporter 24 of the toner container 15 includes an annular exposed piece 47, a coupling piece 48 protruding from a center portion of the exposed piece 47 to the left side (the inside in the left-and-right direction), a boss piece 49 protruding from the center portion of the exposed piece 47 to the right side (the outside in the left-and-right direction) and a pair of inserted pieces 50 protruding from the exposed piece 47 at an outer circumference of the boss piece 49 to the right side (the outside in the left-and-right direction).

With reference to FIG. 3, the exposed piece 47 of the supporter 24 is arranged at the right side (the outside in the left-and-right direction) of the storage 31 of the case main body 21, and exposed to the outside of the case main body 21. Around an outer circumferential face of the exposed piece 47, a driving gear 52 is provided. The driving gear 52 is meshed with the driven gear 45 of the conveyer 23. Thereby, the supporter 24 is connected to the conveyer 23.

The coupling piece 48 of the supporter 24 penetrates through the supporting hole 35 provided in the right side wall 31R of the storage 31 of the case main body 21. Thereby, the supporter 24 is rotatably supported by the case main body 21. A tip end portion of the coupling piece 48 is inserted into an inside of the storage 31, and fixed to a right end portion of the agitating shaft 40 of the agitator 22. Thereby, the supporter 24 is connected to the agitator 22, and rotatable together with the agitator 22 around the first rotation axis X.

With reference to FIG. 4, at a right end portion (an end portion at the outside in the left-and-right direction) of each inserted piece 50 of the supporter 24, a hook 54 is provided. The hook 54 is protruded to an outside in a radial direction (a direction separated from the first rotation axis X).

Figure 5:
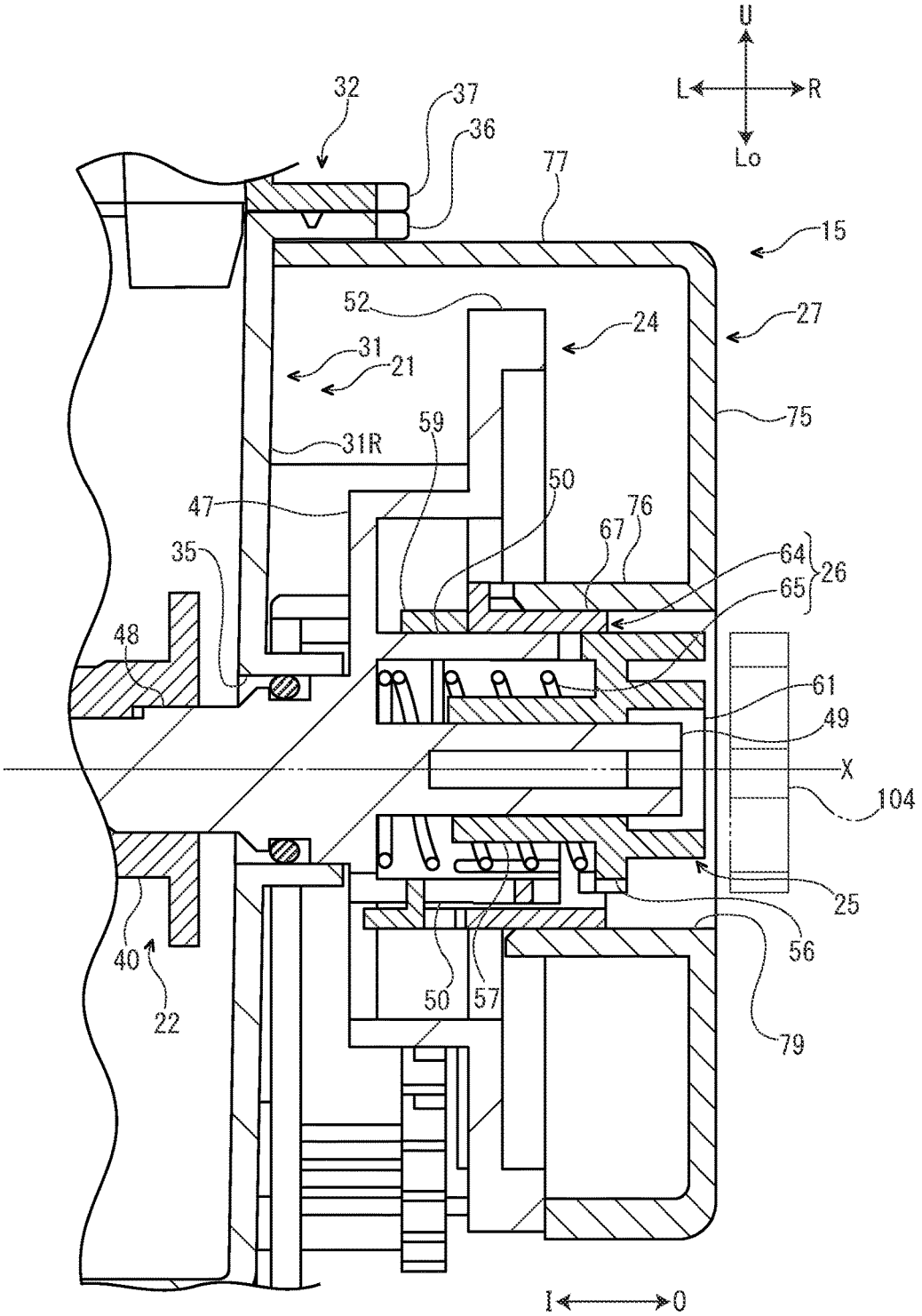
FIG. 5 is a sectional view showing a state where the transmitter is in a first position, in the toner container according to the first embodiment of the present disclosure.
Figure 6:
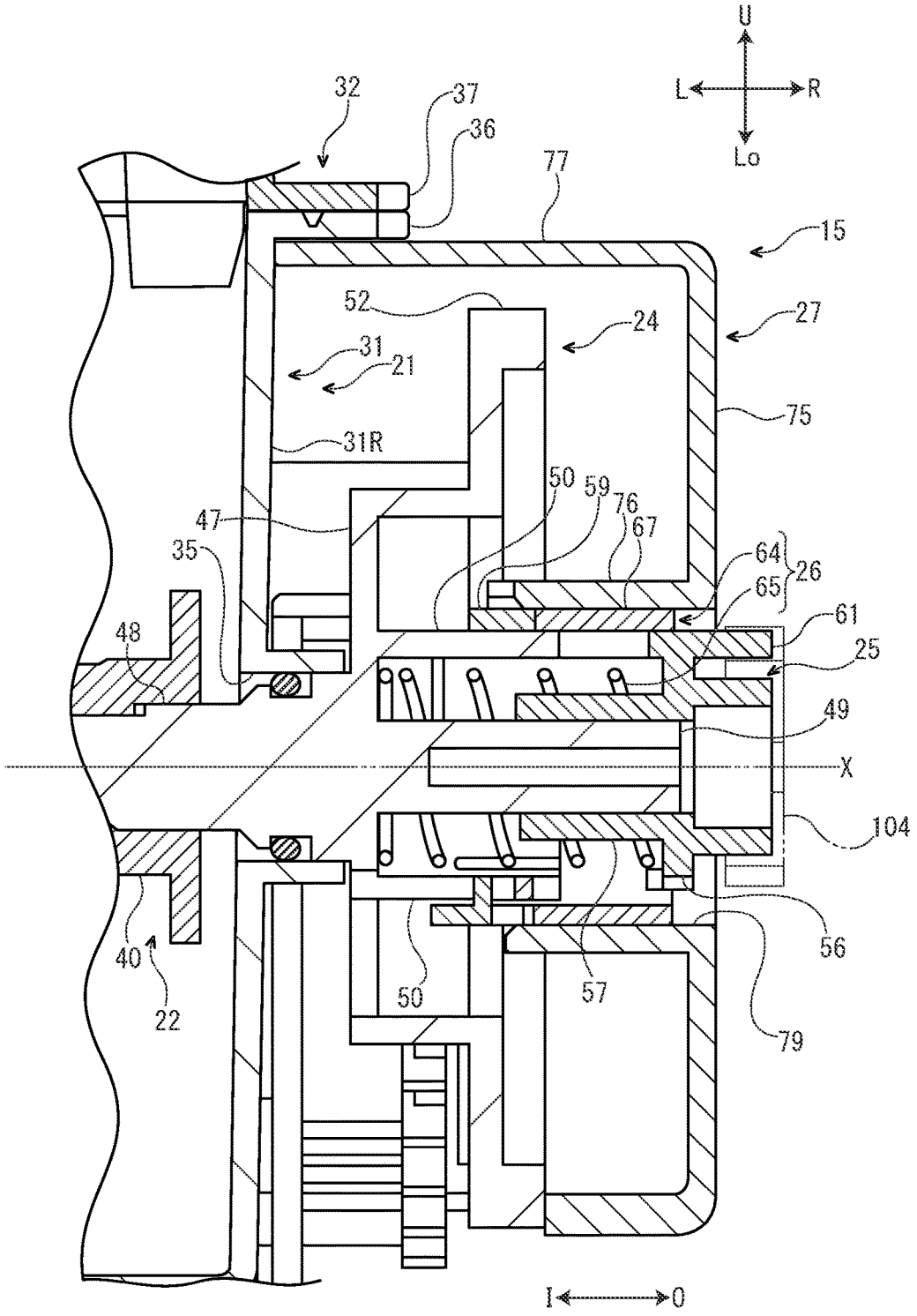
FIG. 6 is a sectional view showing a state where the transmitter is in a second position, in the toner container according to the first embodiment of the present disclosure.

With reference to FIG. 5 and FIG. 6, the transmitter 25 of the toner container 15 is arranged at the right side (the outside in the left-and-right direction) of the storage 31 of the case main body 21 and outside the case main body 21. The transmitter 25 moves linearly along the left-and-right direction between a first position (refer to FIG. 5) and a second position (refer to FIG. 6) which is arranged at the right side (the outside in the left-and-right direction) of the first position.

Figure 7:
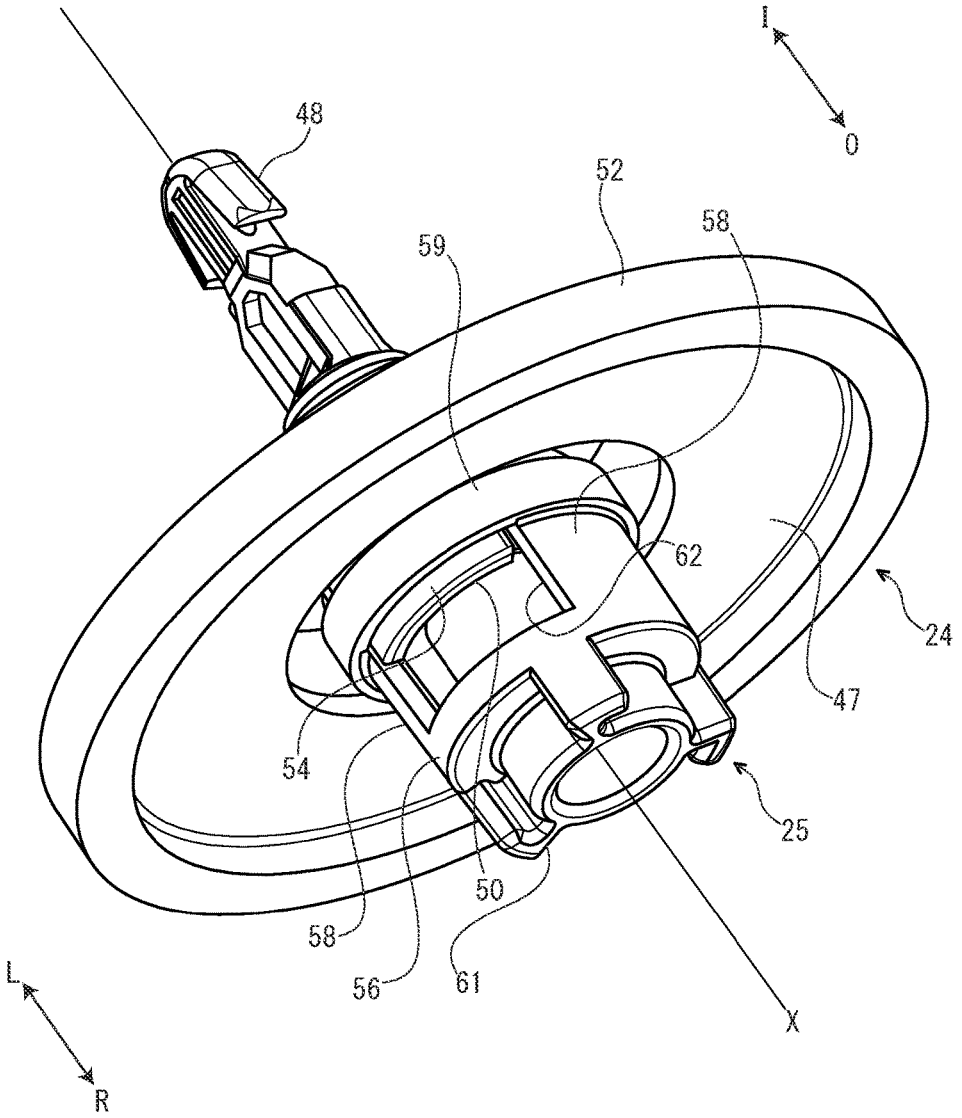
FIG. 7 is a perspective view showing the supporter and the transmitter, in the toner container according to the first embodiment of the present disclosure.

With reference to FIG. 4 and FIG. 7, the transmitter 25 includes a transmitting piece 56, a cylindrical piece 57 protruding from a center portion of the transmitting piece 56 to the left side (the inside in the left-and-right direction), a pair of protruding pieces 58 protruding from the transmitting piece 56 at an outer circumference of the cylindrical piece 57 to the left side (the inside in the left-and-right direction) and an approximate annular fixing piece 59 fixed to outer circumferential faces of left side portions of the pair of protruding pieces 58. On a right face (a face at the outside in the left-and-right direction) of the transmitting piece 56, a transmitting coupling 61 is provided. Into the cylindrical piece 57, the boss piece 49 of the supporter 24 is inserted. A pair of inserting grooves 62 is formed between the pair of protruding pieces 58. Into each inserting groove 62, each inserted piece 50 of the supporter 24 is inserted. According to the configuration described above, the transmitter 25 is supported by the supporter 24 in a state where the transmitter 25 is movable along the left-and-right direction and is not rotatable with respect to the supporter 24. The fixing piece 59 engagingly locks the hook 54 of each inserted piece 50. Thereby, each inserted piece 50 is inhibited from being removed from each inserting groove 62.

With reference to FIG. 4, the moving mechanism 26 of the toner container 15 includes a holder 64 and a coil spring 65 (an example of a biasing member).

Figure 8:
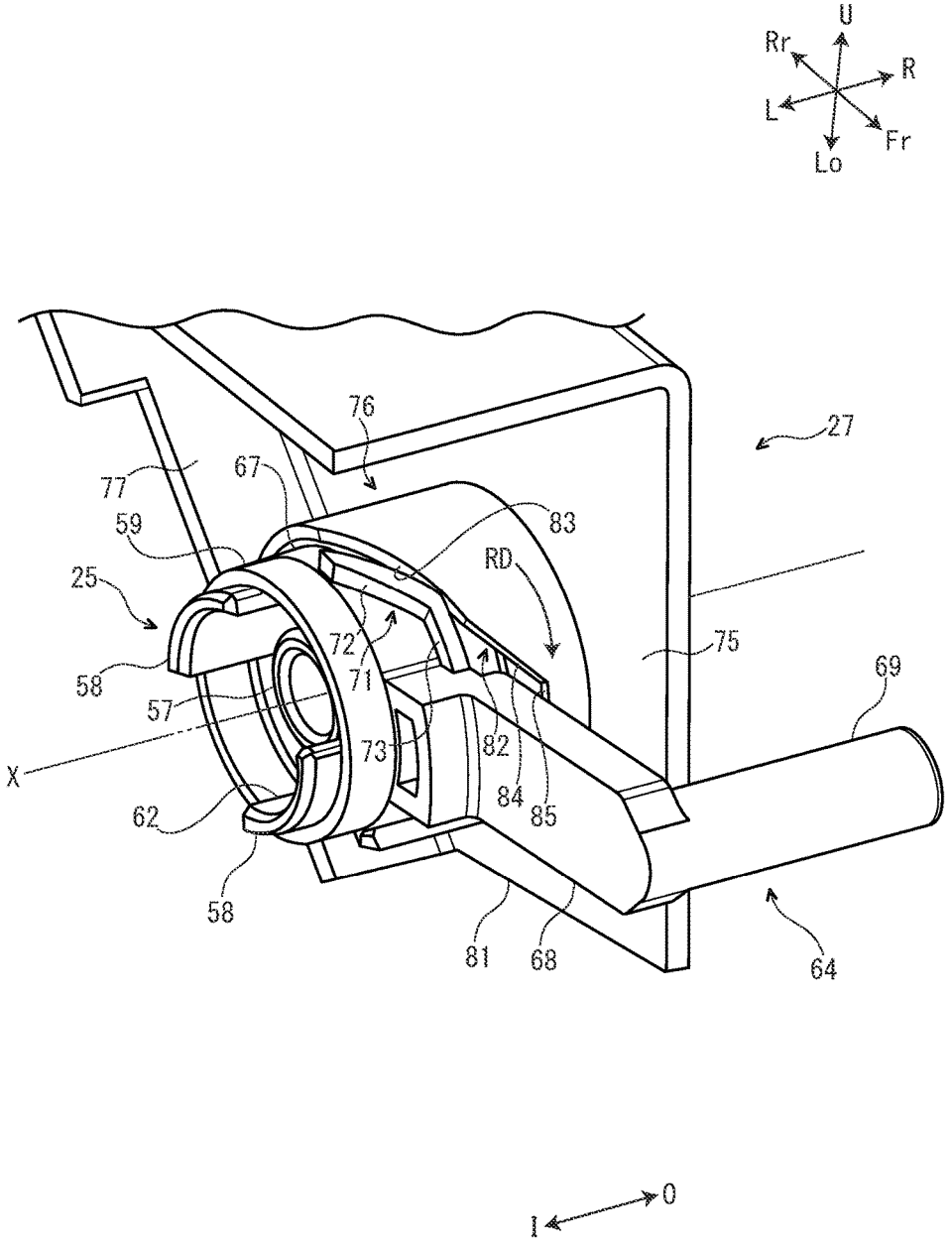
FIG. 8 is a perspective view showing a state where a holder is in a first holding position, in the toner container according to the first embodiment of the present disclosure.
Figure 9:
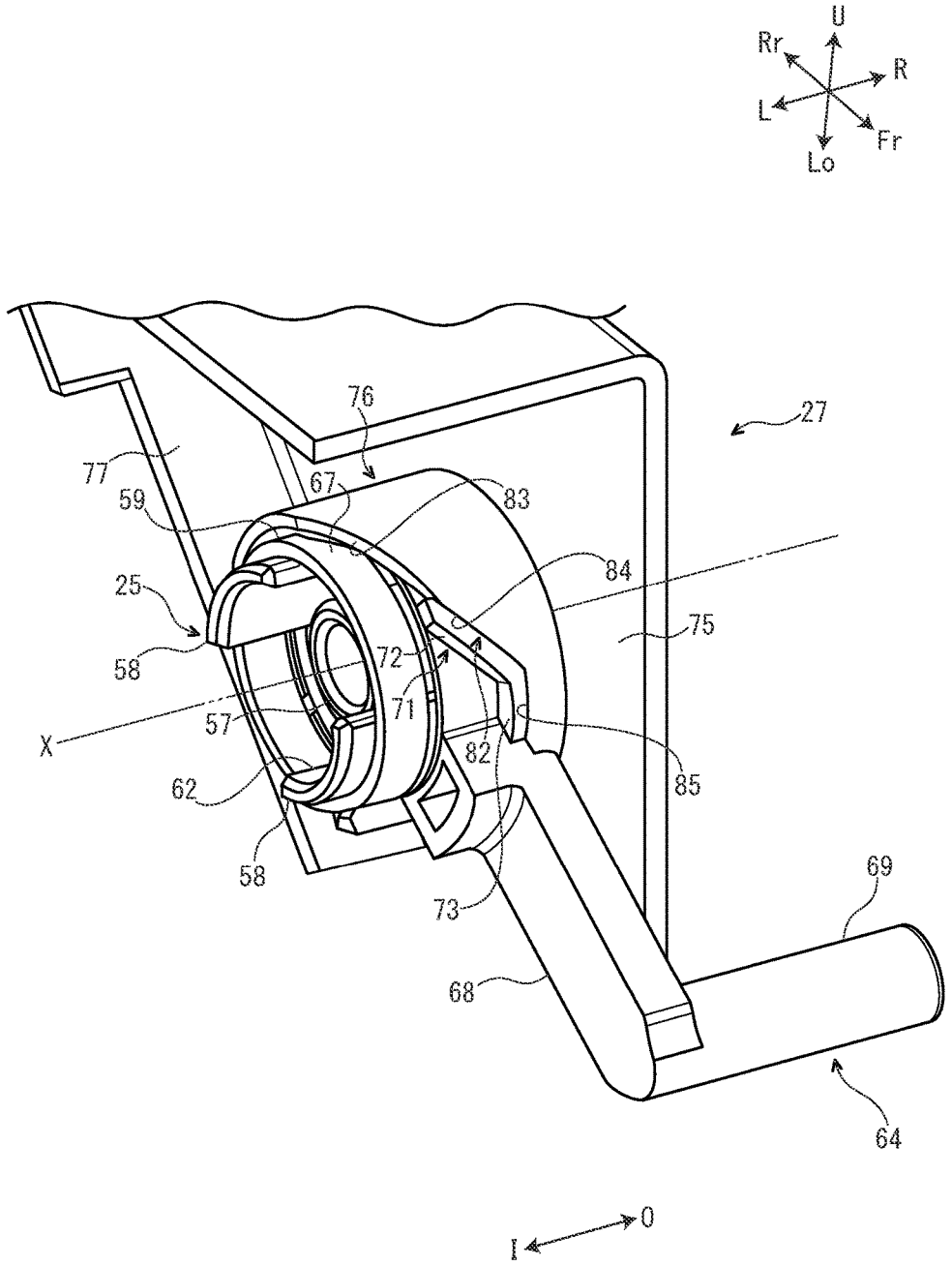
FIG. 9 is a perspective view showing a state where the holder is in a second holding position, in the toner container according to the first embodiment of the present disclosure.

With reference to FIG. 8 to FIG. 9, the holder 64 of the moving mechanism 26 rotates between a first holding position (refer to FIG. 8) where the holder 64 holds the transmitter 25 in the first position and a second holding position (refer to FIG. 9) where the holder 64 holds the transmitter 25 in the second position. An arrow RD shown in each figure indicates a rotating direction of the holder 64 from the first holding position to the second holding position (hereinafter, called as "a rotating direction RD").

With reference to FIG. 4, the holder 64 includes a base part 67, an arm part 68 extending linearly from an outer circumferential face of the base part 67 to an outside in a radial direction (a direction separated from the first rotation axis X) and a boss part 69 extending linearly from an outer end portion of the arm part 68 in the radial direction to the right side (the outside in the left-and-right direction).

The base part 67 of the holder 64 is formed in a cylindrical shape with the first rotation axis X as an axis center. Into an inner circumference of the base part 67, the pair of protruding pieces 58 of the transmitter 25 is rotatably inserted.

Thereby, the base part 67 holds the transmitter 25 rotatably. A left edge portion (an edge portion at the inside in the left-and-right direction) of the base part 67 comes into contact with the fixing piece 59 of the transmitter 25.

On an outer circumferential face of the base part 67 of the holder 64, a pair of guided parts 71 (only one of them, the one at a near side on the figure, is shown in FIG. 4) is protruded. Each guided part 71 includes an inclined piece 72 and a non-inclined piece 73 provided at a downstream side of the inclined piece 72 in the rotating direction RD, and is formed in an approximate V-shape. The inclined piece 72 is inclined to the right side (the outside in the left-and-right direction) from the upstream side to the downstream side in the rotating direction RD. The non-inclined piece 73 is provided along the rotating direction RD.

With reference to FIG. 5 and FIG. 6, the coil spring 65 of the moving mechanism 26 is interposed between the exposed piece 47 of the supporter 24 and the transmitting piece 56 of the transmitter 25. The coil spring 65 is attached to an outer circumference of the cylindrical piece 57 of the transmitter 25. The coil spring 65 presses the transmitter 25 to the right side (the outside in the left-and-right direction) to bias the transmitter 25 to the second position (refer to FIG. 6) and to bias the holder 64 to the second holding position (refer to FIG. 9).

With reference to FIG. 4, the cover 27 of the toner container 15 includes a plate-shaped main wall 75, a guide wall 76 arranged at a center side of the main wall 75 and a circumferential wall 77 arranged at an outer circumference side of the main wall 75.

The main wall 75 of the cover 27 is provided along a plane crossing the first rotation axis X. In a center portion of the main wall 75, a circular through hole 79 is provided. With reference to FIG. 2, in a front portion of the main wall 75, an arc-shaped curved hole 80 is provided. Through the curved hole 80, the boss part 69 of the holder 64 is penetrated. Thereby, a tip end portion of the boss part 69 is exposed to the right side (the outside in the left-and-right direction) of the cover 27. In a lower portion of the cover 27, a notch 81 is formed along the main wall 75 and the circumferential wall 77.

With reference to FIG. 4, the guide wall 76 of the cover 27 is formed in a cylindrical shape. The guide wall 76 is protruded from the main wall 75 at an outer circumference of the through hole 79 to the left side (the inside in the left-and-right direction). Into the guide wall 76, the base part 67 of the holder 64 is inserted. Thereby, the cover 27 supports the holder 64 rotatably.

On a left edge portion (an edge portion at the inside in the left-and-right direction) of the guide wall 76 of the cover 27, a pair of guide parts 82 is provided. Each guide part 82 includes an upstream side inclined part 83, a downstream side inclined part 84 provided at the downstream side of the upstream side inclined part 83 in the rotating direction RD and a non-inclined part 85 provided at the downstream side of the downstream side inclined part 84 in the rotating direction RD. The upstream side inclined part 83 and the downstream side inclined part 84 are inclined to the right side (the outside in the left-and-right direction) from the upstream side to the downstream side in the rotating direction RD. An inclined degree of the upstream side inclined part 83 to the rotating direction RD is smaller than an inclined degree of the inclined piece 72 of each guided part 71 provided in the base part 67 of the holder 64 to the rotating direction RD. An inclined degree of the downstream side inclined part 84 to the rotating direction RD is the same as the inclined degree of the inclined piece 72 to the rotating direction RD. The non-inclined part 85 is provided along the rotating direction RD.

Figure 10:
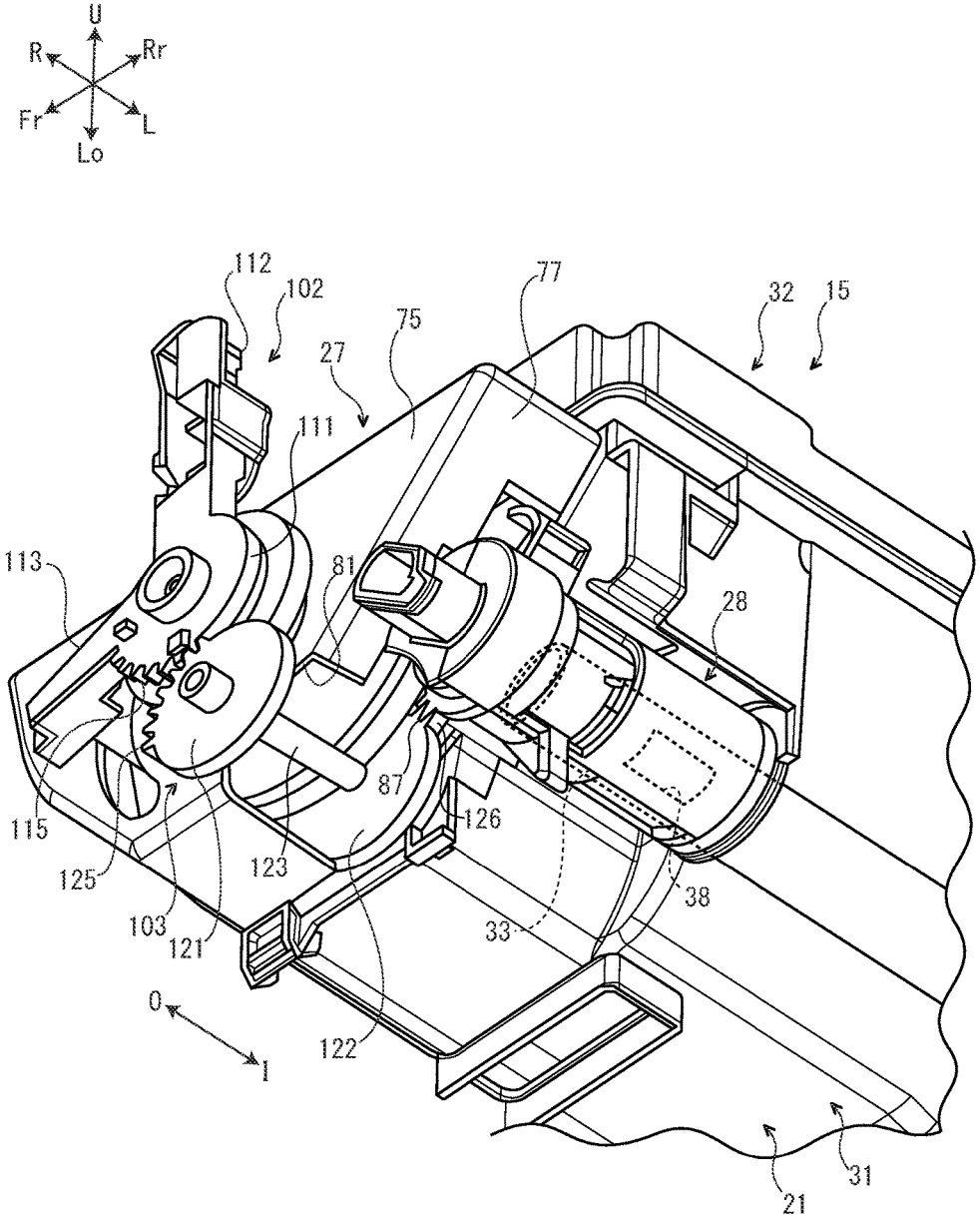
FIG. 10 is a perspective view showing a state where a shutter is in a closing position, in the toner container according to the first embodiment of the present disclosure.
Figure 11:
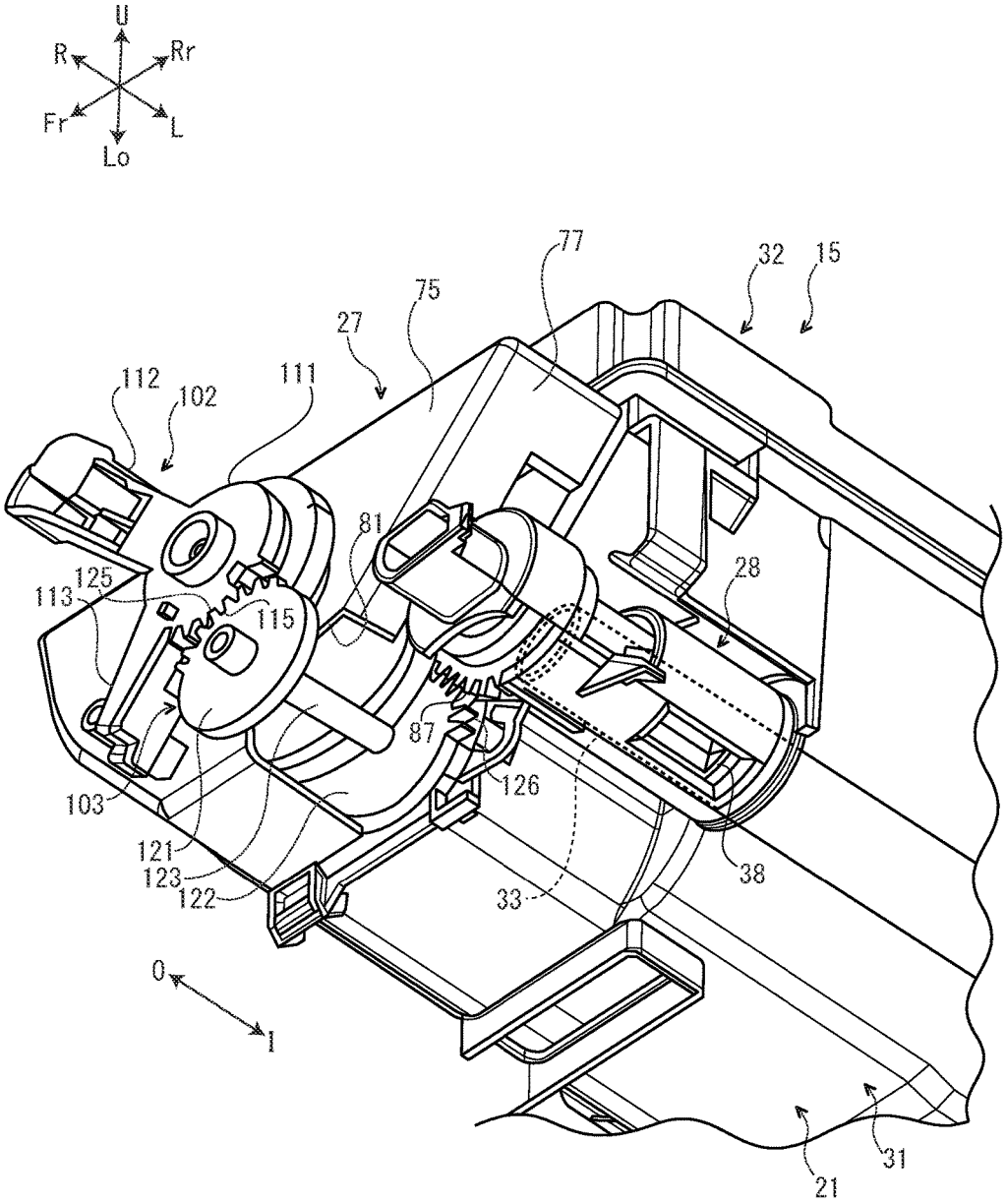
FIG. 11 is a perspective view showing a state where the shutter is in an opening position, in the toner container according to the first embodiment of the present disclosure.

With reference to FIG. 10 and FIG. 11, the shutter 28 of the toner container 15 is formed in an approximate cylindrical shape. The shutter 28 is rotatably attached to an outer circumference of the duct 33 of the case main body 21. The shutter 28 is rotatable between a closing position (refer to FIG. 10) where the shutter 28 closes the discharge port 38 of the duct 33 and an opening position (refer to FIG. 11) where the shutter 28 opens the discharge port 38 of the duct 33. Around an outer circumferential face of the shutter 28, a shutter side gear 87 is provided.

Next, the attachment part 16 will be described in detail.

Figure 12:
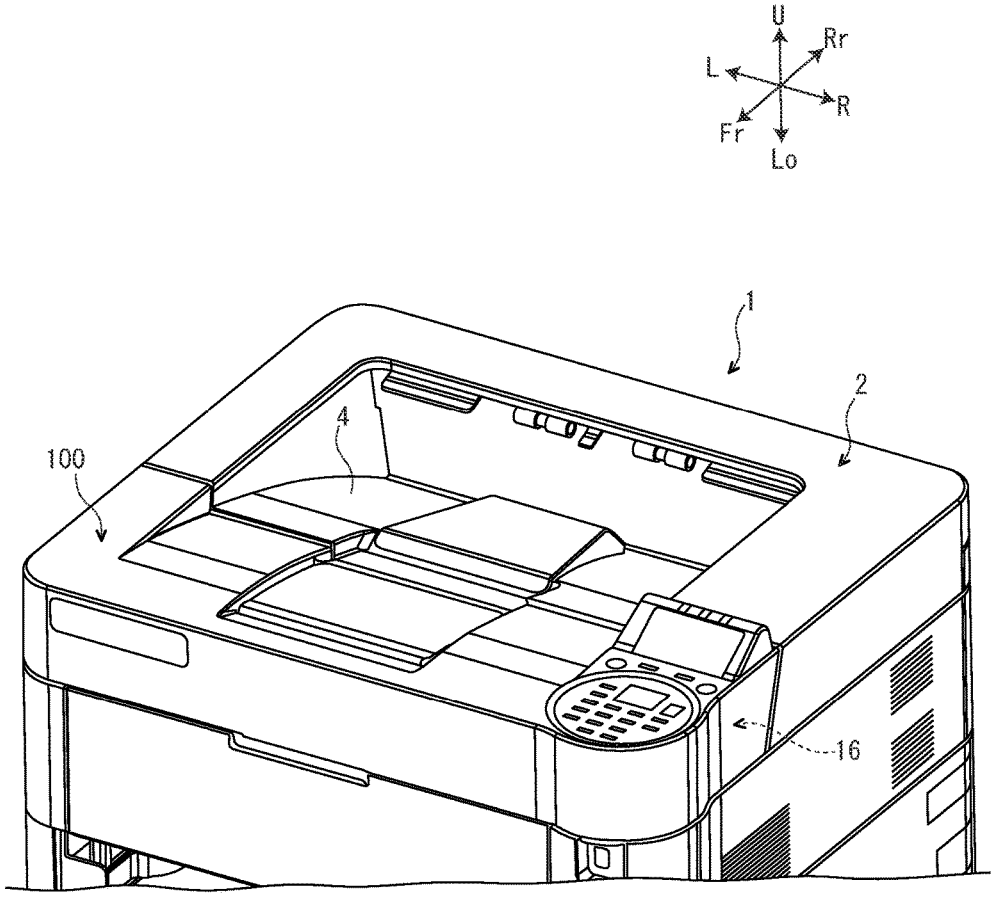
FIG. 12 is a perspective view showing a state where a top cover is closed, in the printer according to the first embodiment of the present disclosure.
Figure 13:
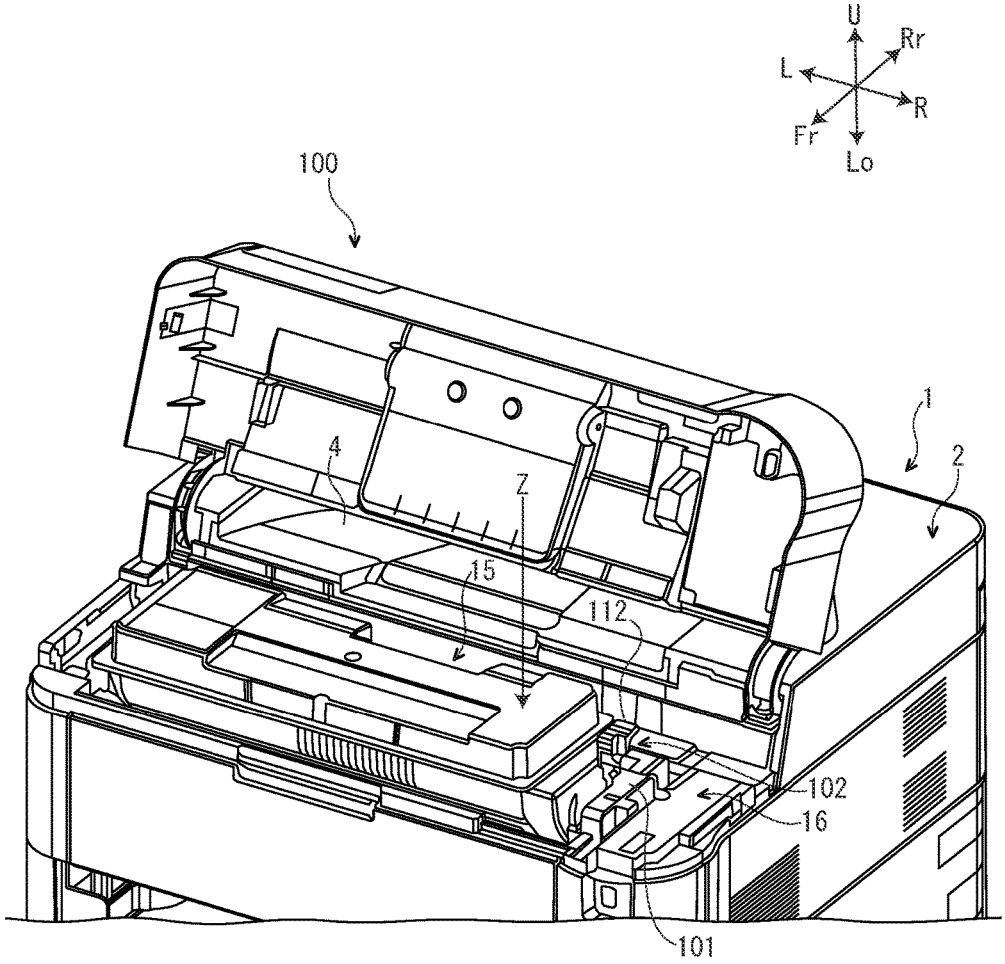
FIG. 13 is a perspective view showing a state where the top cover is opened, in the printer according to the first embodiment of the present disclosure.

With reference to FIG. 12 and FIG. 13, an upper side of the attachment part 16 is covered with an openable and closable top cover 100. By opening the top cover 100, it becomes possible to attach and detach the toner container 15 to and from the attachment part 16. With reference to FIG. 13, to the attachment part 16, the toner container 15 is detachably attached along an attachment direction Z from an upper side to a lower side.

Figure 14:
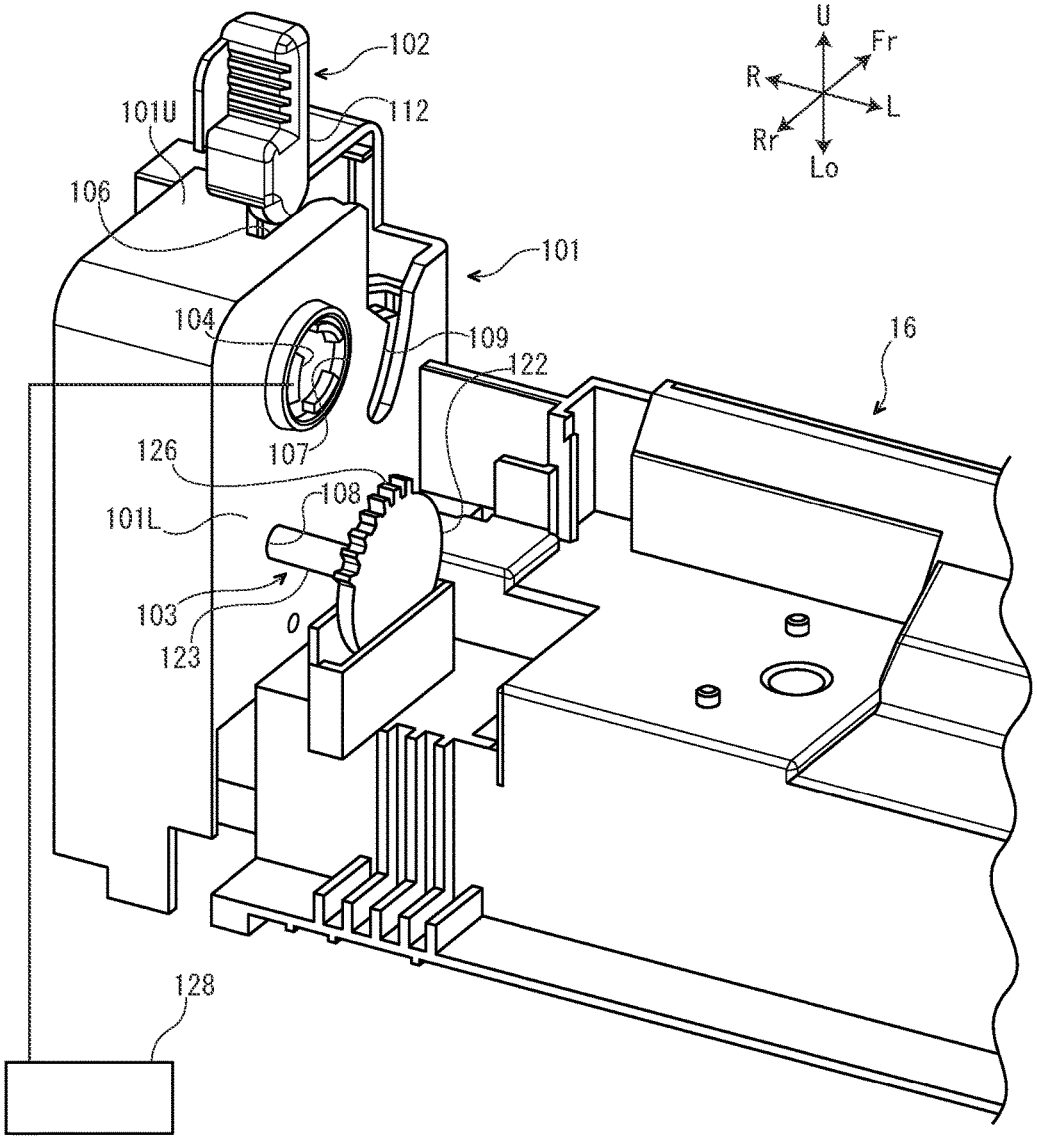
FIG. 14 is a perspective view showing an attachment part according to the first embodiment of the present disclosure.

With reference to FIG. 14, the attachment part 16 includes a case 101, a manipulation member 102 supported by an upper portion of the case 101, a connector 103 supported by a lower portion of the case 101 and a driving coupling 104 stored in the upper portion of the case 101.

The case 101 of the attachment part 16 is arranged at a right end side of the attachment part 16. In an upper wall 101U of the case 101, an upper side slit 106 is provided. In an upper portion of a left wall 101L of the case 101, a circular attachment hole 107 is provided. In a lower portion of the left wall 101L of the case 101, a circular axis hole 108 is provided. In a front portion of the left wall 101L of the case 101, an arc-shaped front side slit 109 is provided.

Figure 15:
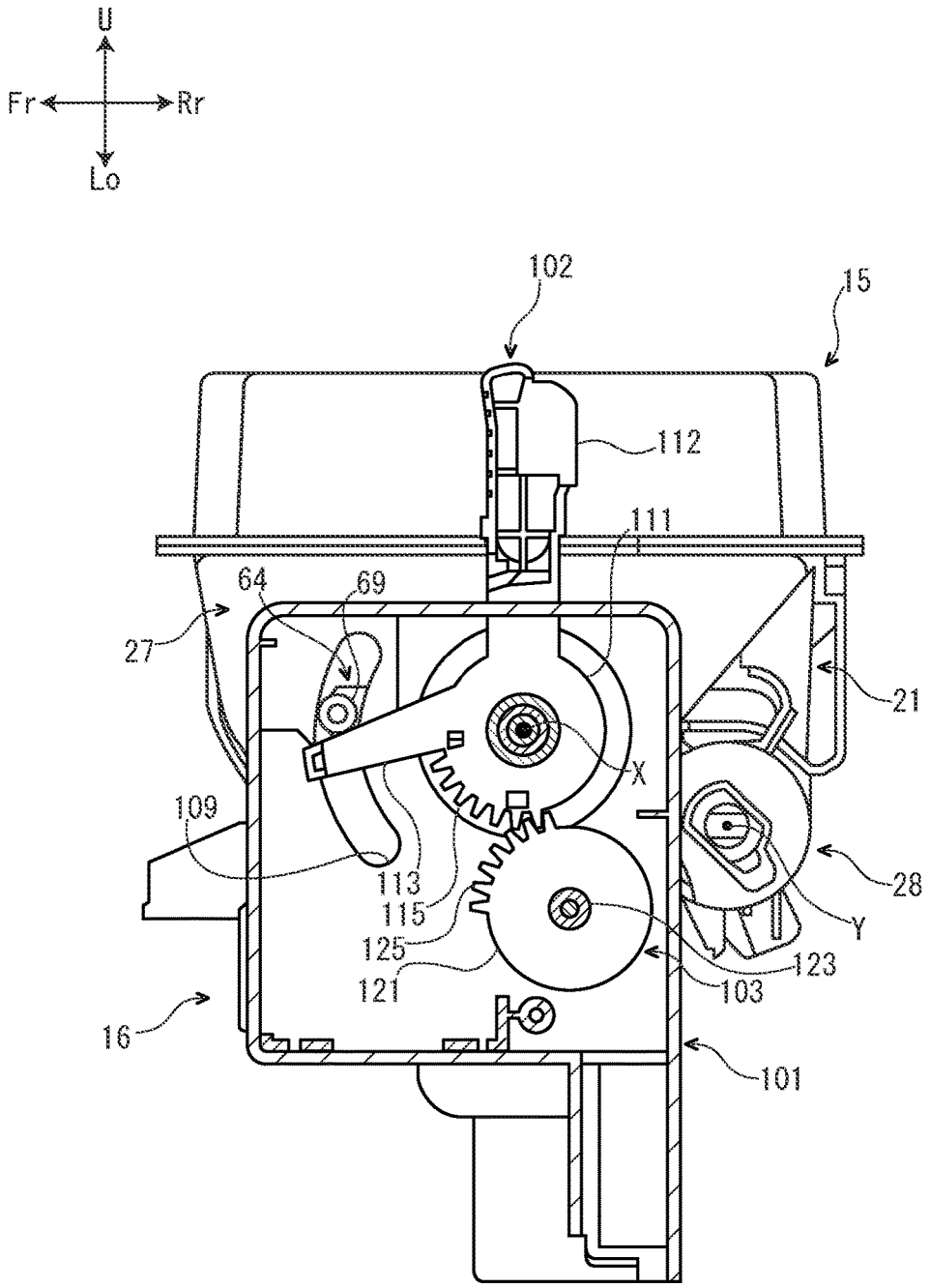
FIG. 15 is a sectional view showing a state where the toner container is attached to the attachment part and a manipulation member is in a first manipulating position, in the printer according to the first embodiment of the present disclosure.
Figure 16:
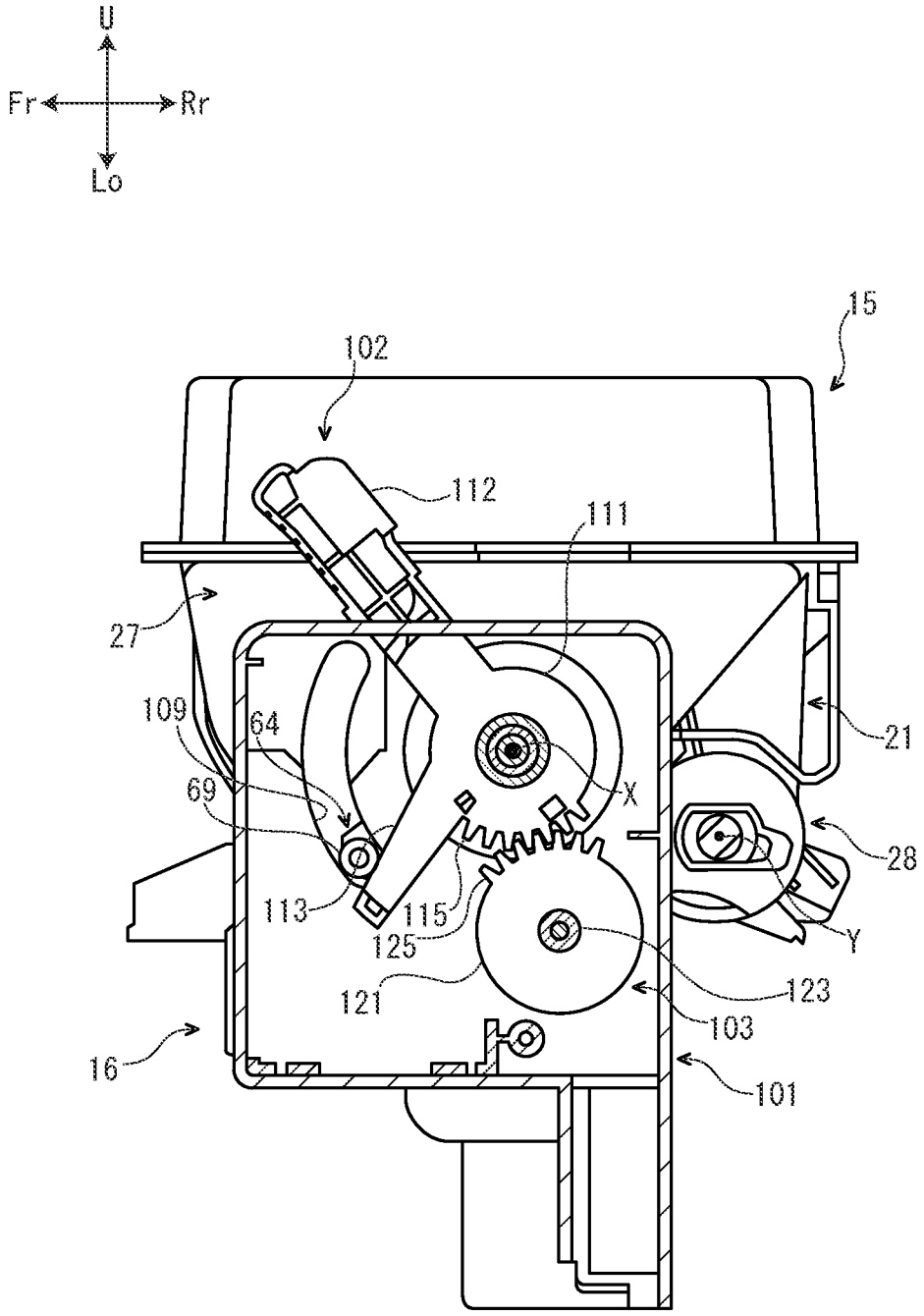
FIG. 16 is a sectional view showing a state where the toner container is attached to the attachment part and the manipulation member is in a second manipulating position, in the printer according to the first embodiment of the present disclosure.

With reference to FIG. 15 and FIG. 16, the manipulation member 102 of the attachment part 16 has a fulcrum part 111, a manipulated part 112 extending linearly from an outer circumference of the fulcrum part 111 to an upper side and a contacted part 113 extending linearly from the outer circumference of the fulcrum part 111 to a front side. The manipulation member 102 is rotatable around the fulcrum part 111 between a first manipulating position (refer to FIG. 15) where the manipulated part 112 is in an approximate vertical posture and a second manipulating position (refer to FIG. 16) where the manipulated part 112 is inclined to the front side with respect to the first manipulating position. Around an outer circumferential face of the fulcrum part 111, a manipulation member side gear 115 is provided.

With reference to FIG. 14, the manipulation member 102 is stored in the case 101 except an upper portion of the manipulated part 112. The upper portion of the manipulated part 112 is exposed to an outside of the case 101 through the upper side slit 106 of the case 101.

With reference to FIG. 10 and FIG. 11, the connector 103 of the attachment part 16 includes a first connecting piece 121, a second connecting piece 122 provided at a left side of the first connecting piece 121 and a coupling shaft 123 coupling the first connecting piece 121 and the second connecting piece 122.

With reference to FIG. 15 and FIG. 16, the first connecting piece 121 of the connector 103 is stored in the case 101. Around an outer circumferential face of the first connecting piece 121, a first connecting gear 125 is provided. The first connecting gear 125 is meshed with the manipulation member side gear 115 of the fulcrum part 111 of the manipulation member 102. Thereby, the connector 103 is connected to the manipulation member 102.

With reference to FIG. 14, the second connecting piece 122 of the connector 103 is exposed to the outside of the case 101. Around an outer circumferential face of the second connecting piece 122, a second connecting gear 126 is provided.

The coupling shaft 123 of the connector 103 is penetrated through the axis hole 108 of the case 101. Thereby, the connector 103 is supported by the case 101 in a state where the connector 103 is rotatable around the coupling shaft 123.

The driving coupling 104 of the attachment part 16 is rotatably inserted into an inner circumference of the attachment hole 107 of the case 101. The driving coupling 104 is exposed to the outside of the case 101 through the attachment hole 107. The driving coupling 104 is connected to a driving source 128 constituted by a motor and the others.

Next, an operation to discharge the toner from the toner container 15 will be described.

With reference to FIG. 3, when the toner is discharged from the toner container 15, in a state where the transmitting coupling 61 of the transmitter 25 is coupled to the driving coupling 104 and the discharge port 38 of the duct 33 is opened, the driving source 128 is driven. When the driving source 128 is driven, by rotation driving force from the driving source 128, the driving coupling 104 is rotated. When the driving coupling 104 is thus rotated, rotation of the driving coupling 104 is transmitted to the agitator 22 by the transmitter 25 and the supporter 24, and the agitator 22 is rotated. As a result, the toner stored in the storage 31 of the case main body 21 is agitated by the agitator 22.

When the driving coupling 104 is rotated as described above, the rotation is transmitted to the conveyer 23 by the transmitter 25 and the supporter 24, and the conveyer 23 is rotated. As a result, as shown in an arrow A in FIG. 3, the toner stored in the storage 31 and the duct 33 of the case main body 21 is conveyed to the discharge port 38 of the duct 33 by the conveyer 23. The toner thus conveyed to the discharge port 38 of the duct 33 is discharged through the discharge port 38 of the duct 33 to the outside of the toner container 15. The toner discharged to the outside of the toner container 15 is replenished to the developing device 10 (refer to FIG. 1).

Next, an operation to set the toner container 15 to the attachment part 16 by a worker, such as a user and a serviceman, will be described.

In a state where the toner container 15 is detached from the attachment part 16, the holder 64 is in the second holding position (refer to FIG. 9), and the inclined piece 72 and the non-inclined piece 73 of the guided part 71 of the holder 64 respectively come into contact with the downstream side inclined part 84 and the non-inclined part 85 of the guide part 82 of the cover 27. The transmitter 25 is held in the second position (refer to FIG. 6) by the holder 64, and the transmitting coupling 61 of the transmitter 25 protrudes to the right side (the outside in the left-and-right direction) further than the through hole 79 of the cover 27. The shutter 28 is arranged in the closing position (refer to FIG. 10), and the manipulation member 102 is arranged in the first manipulating position (refer to FIG. 15).

Figure 17:
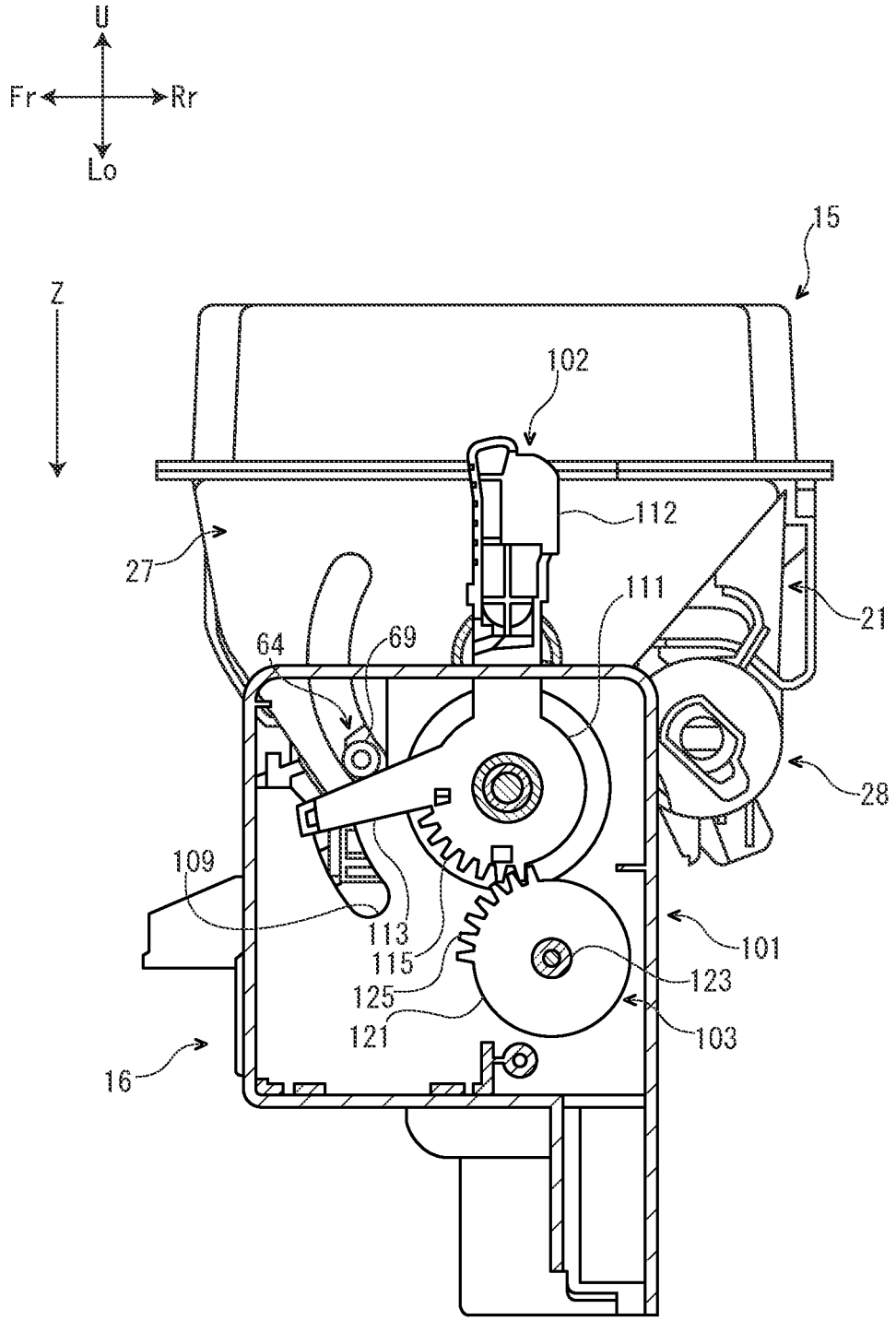
FIG. 17 is a sectional view showing a state where the toner container is attached to a predetermined position in the attachment part, in the printer according to the first embodiment of the present disclosure.

When the worker sets the toner container 15 to the attachment part 16, the worker inserts the toner container 15 to the attachment part 16 along the attachment direction Z. As shown in FIG. 17, when the toner container 15 is inserted to a predetermined position in the attachment part 16, the boss part 69 of the holder 64 comes into contact with the contacted part 113 of the manipulation member 102. That is, the holder 64 is engaged with the manipulation member 102.

From this state, when the worker further inserts the toner container 15 to the attachment part 16 along the attachment direction Z, as shown in FIG. 15, the toner container 15 is attached to the attachment part 16. Consequently, the contacted part 113 of the manipulation member 102 presses the boss part 69 of the holder 64 to the upper side, and the holder 64 rotates from the second holding position (refer to FIG. 9) to the first holding position (refer to FIG. 8) against biasing force of the coil spring 65. Consequently, the inclined piece 72 of the guided part 71 of the holder 64 moves along the downstream side inclined part 84 of the guide part 82 of the cover 27, and a boundary portion between the inclined piece 72 and the non-inclined piece 73 of the guided part 71 comes into contact with the upstream side inclined part 83 of the guide part 82. Consequently, the holder 64 moves to the left side (the inside in the left-and-right direction), and the transmitter 25 held by the holder 64 moves from the second position (refer to FIG. 6) to the first position (refer to FIG. 5). As a result, the transmitting coupling 61 of the transmitter 25 is retracted to an inside of the through hole 79 of the cover 27 and faces the driving coupling 104. In this state, an entire part of the transmitter 25 is retracted to an inside of the cover 27.

Additionally, as the toner container 15 is attached to the attachment part 16 as described above, as shown in FIG. 10, the shutter side gear 87 of the shutter 28 is meshed with the second connecting gear 126 of the second connecting piece 122 of the connector 103. Thereby, the manipulation member 102 is connected to the shutter 28 by the connector 103. The coupling shaft 123 of the connector 103 is arranged in a position of the notch 81 of the cover 27 to inhibit interference of the connector 103 with the cover 27.

Next, the worker presses the manipulated part 112 of the manipulation member 102 to the front side. The pressing rotates the manipulation member 102 from the first manipulating position (refer to FIG. 15) to the second manipulating position (refer to FIG. 16). Consequently, the pressing of the holder 64 to the first holding position (refer to FIG. 8) by the manipulation member 102 is released, and the holder 64 rotates from the first holding position (refer to FIG. 8) to the second holding position (refer to FIG. 9) by the biasing force of the coil spring 65. Consequently, the inclined piece 72 of the guided part 71 of the holder 64 moves along the downstream side inclined part 84 of the guide part 82 of the cover 27, and the inclined piece 72 and the non-inclined piece 73 of the guided part 71 respectively come into contact with the downstream side inclined part 84 and the non-inclined part 85 of the guide part 82. Consequently, the holder 64 moves to the right side (the outside in the left-and-right direction), and the transmitter 25 held by the holder 64 moves from the first position (refer to FIG. 5) to the second position (refer to FIG. 6). As a result, the transmitting coupling 61 of the transmitter 25 protrudes to the right side (the outside in the left-and-right direction) further than the through hole 79 of the cover 27, and is coupled to the driving coupling 104.

Additionally, as the manipulation member 102 rotates from the first manipulating position (refer to FIG. 15) to the second manipulating position (refer to FIG. 16) as described above, rotation of the manipulation member 102 is transmitted to the shutter 28 by the connector 103, and the shutter 28 rotates from the closing position (refer to FIG. 10) to the opening position (refer to FIG. 11). As a result, the discharge port 38 of the duct 33 is opened. By the above operation, the setting of the toner container 15 to the attachment part 16 is completed.

When the toner container 15 is detached from the attachment part 16, the worker rotates the manipulation member 102 from the second manipulating position (refer to FIG. 16 to the first manipulating position (refer to FIG. 15) and then pulls out the toner container 15 from the attachment part 16 along a direction opposite to the attachment direction Z.

In the present embodiment, as described above, the toner container 15 includes the moving mechanism 26 which moves the transmitter 25 between the first position and the second position, and the attachment part 16 includes the manipulation member 102 rotating between the first manipulating position and the second manipulating position. In such a configuration, as the toner container 15 is attached to the attachment part 16, the holder 64 of the moving mechanism 26 is engaged with the manipulation member 102 and the transmitting coupling 61 faces the driving coupling 104. Then, as the manipulation member 102 is rotated from the first manipulating position to the second manipulating position in the state where the toner container 15 is attached to the attachment part 16, the moving mechanism 26 moves the transmitter 25 from the first position to the second position, and the transmitting coupling 61 is coupled to the driving coupling 104. By applying such a configuration, the attachment part 16 eliminates the need for a mechanism to move the driving coupling 104 in the left-and-right direction so that it becomes possible to couple the transmitting coupling 61 to the driving coupling 104 without complication in the structure of the attachment part 16.

Additionally, as the toner container 15 is attached to the attachment part 16, the manipulation member 102 presses the boss part 69 of the holder 64, and the holder 64 rotates from the second holding position to the first holding position against the biasing force of the coil spring 65. Then, as the manipulation member 102 is rotated from the first manipulating position to the second manipulating position in the state where the toner container 15 is attached to the attachment part 16, the pressing of the holder 64 to the first holding position by the manipulation member 102 is released, and the holder 64 rotates from the first holding position to the second holding position by the biasing force of the coil spring 65. By applying such a configuration, it becomes possible to rotate the holder 64 between the first holding position and the second holding position by using a simple structure.

Additionally, the base part 67 of the holder 64 is inserted in the guide wall 76 of the cover 27. By applying such a configuration, the cover 27 is able to support the holder 64 rotatably by using a simple structure.

Additionally, the upstream side inclined part 83 and the downstream side inclined part 84 of the guide part 82 of the cover 27 are inclined to the right side (the outside in the left-and-right direction) from the upstream side to the downstream side in the rotating direction RD, and the holder 64 includes the guided part 71 coming into contact with the upstream side inclined part 83 and the downstream side inclined part 84. By applying such a configuration, it becomes possible to move the holder 64 in the left-and-right direction surely as the holder 64 rotates.

Additionally, the transmitter 25 is supported by the supporter 24 in the state where the transmitter 25 is movable along the left-and-right direction and is not rotatable with respect to the supporter 24, and the coil spring 65 is interposed between the supporter 24 and the transmitter 25. By applying such a configuration, it becomes possible to integrate the supporter 24, the transmitter 25 and the coil spring 65 and to arrange them in a narrow space.

Additionally, as the manipulation member 102 is rotated from the first manipulating position to the second manipulating position, the rotation of the manipulation member 102 is transmitted to the shutter 28, and the shutter 28 rotates from the closing position to the opening position. By applying such a configuration, it becomes possible to perform both operations to couple the transmitting coupling 61 to the driving coupling 104 and to open the discharge port 38 of the duct 33 by manipulating of the manipulation member 102 so that a worker's load can be reduced.

In the present embodiment, the manipulation member 102 rotates between the first manipulating position and the second manipulating position. On the other hand, in another embodiment, the manipulation member 102 may move linearly between the first manipulating position and the second manipulating position.

In the present embodiment, the shutter 28 is rotatably attached to the outer circumference of the duct 33 of the case main body 21. On the other hand, in another embodiment, the shutter 28 may be rotatably attached to an inner circumference of the duct 33 of the case main body 21.

In the present embodiment, the manipulation member 102 is connected to the shutter 28 by the connector 103. On the other hand, in another embodiment, the manipulation member 102 may be directly connected to the shutter 28.

In the present embodiment, an entire part of the agitator 22 is stored in the case main body 21. On the other hand, in another embodiment, a part of the agitator 22 may be stored in the case main body 21. In the present embodiment, the conveyer 23 is stored in the case main body 21 except the right end portion of the conveyer 23. On the other hand, in another embodiment, an entire part of the conveyer 23 may be stored in the case main body 21.

In the present embodiment, an entire part of the transmitter 25 is arranged outside the case main body 21. On the other hand, in another embodiment, apart of the transmitter 25 may be arranged outside the case main body 21.

In the present embodiment, the configuration of the present disclosure is applied to the printer 1. On the other hand, in another embodiment, the configuration of the present disclosure may be applied to an image forming apparatus, such as a copying machine, a facsimile and a multifunctional peripheral, other than the printer 1.

A Second Embodiment

Hereinafter, a second embodiment of the present disclosure will be described with reference to FIG. 18 to FIG. 24.

Firstly, the toner container 151 according to the second embodiment will be described. The same configurations as the toner container 151 according to the first embodiment are not described.

Figure 18:
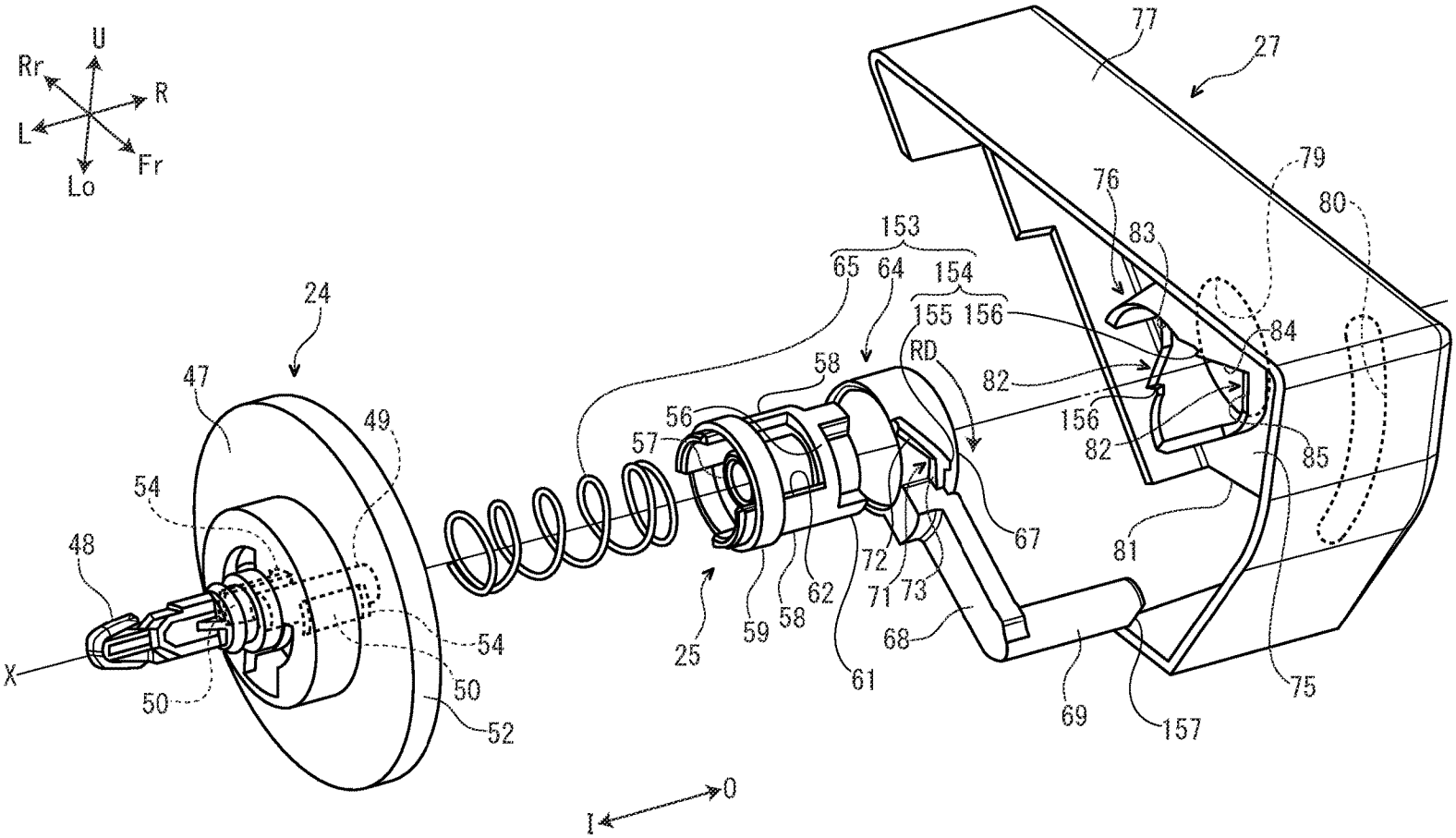
FIG. 18 is a disassembled perspective view showing the supporter, the transmitter, the moving mechanism and the cover, in the toner container according to a second embodiment of the present disclosure.

With reference to FIG. 18, the moving mechanism 153 of the toner container 15 includes a locking mechanism 154, in addition to the holder 64 and the coil spring 65. The locking mechanism 154 includes a pair of first projections 155 (only one of them, the one at the near side on the figure, is shown in FIG. 18) and a pair of second projections 156. Each first projection 155 is protruded from each guided part 71 of the holder 64 to the right side (the outside in the left-and-right direction). Each second projection 156 is protruded from each guide part 82 of the cover 27 to the left side (the inside in the left-and-right direction).

On a right end portion (an end portion at the outside in the left-and-right direction) of the boss part 69 of the holder 64, an inclined face 157 is provided. The inclined face 157 is inclined to the lower side toward the left side (the inside in the left-and-right direction).

Next, the attachment part 152 according to the second embodiment will be described. The same configurations as the attachment part 16 according to the first embodiment are not described.

Figure 19:
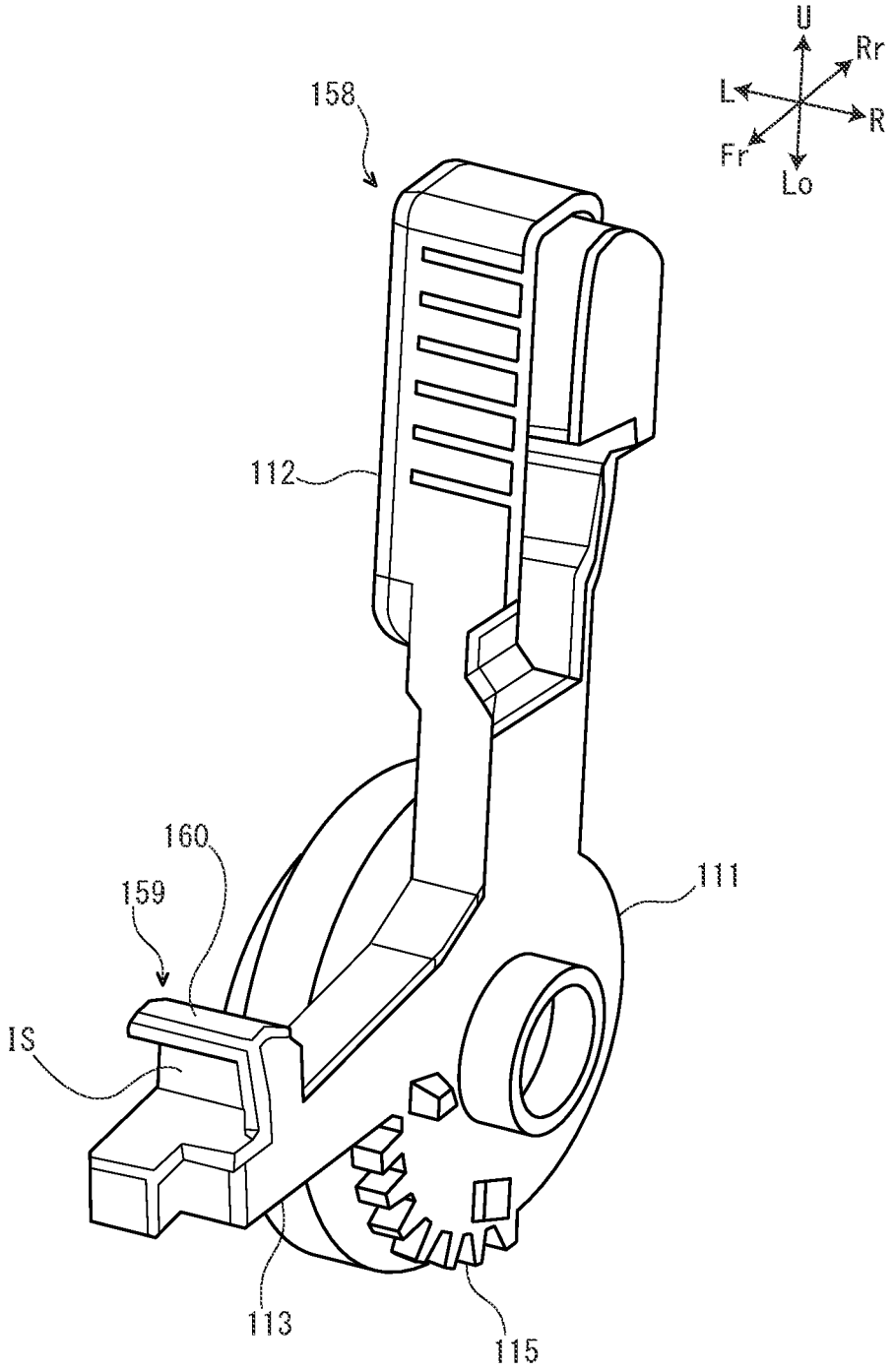
FIG. 19 is a perspective view showing the manipulation member according to the second embodiment of the present disclosure.
Figure 20:
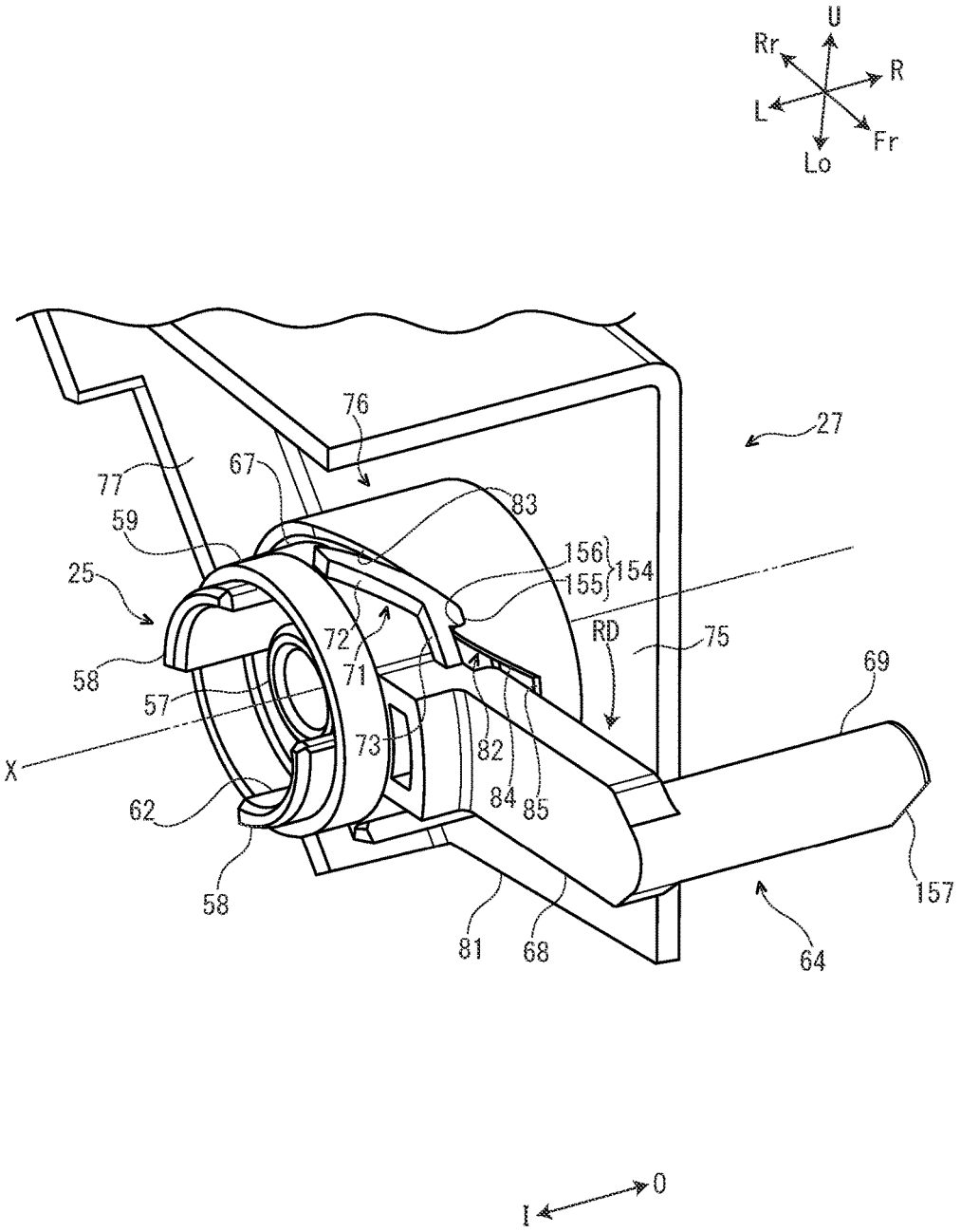
FIG. 20 is a perspective view showing a state where the holder is in the first holding position, in the toner container according to the second embodiment of the present disclosure.

With reference to FIG. 19, the manipulation member 158 of the attachment part 152 includes a protruding part 159, in addition to the fulcrum part 111, the manipulated part 112 and the contacted part 113. The protruding part 159 is protruded from a front portion of the contacted part 113 to the upper side. The protruding part 159 is formed in a shape whose front side and left side are opened. Inside the protruding part 159, an insertion space IS is formed. At an upper end portion of the protruding part 159, a pressing part 160 is provided.

Next, an operation to set the toner container 151 to the attachment part 152 by a worker, such as a user and a serviceman, will be described. The same operations as the first embodiment are not described.

In the state where the toner container 151 is detached from the attachment part 152, each first projection 155 and each second projection 156 of the locking mechanism 154 are engaged with each other, and the holder 64 is held in the first holding position (refer to FIG. 20) against the biasing force of the coil spring 65. That is, the holder 64 is held in the first holding position by the locking mechanism 154. Thereby, the transmitting coupling 61 of the transmitter 25 is retracted to the inside of the through hole 79 of the cover 27.

Figure 21A:
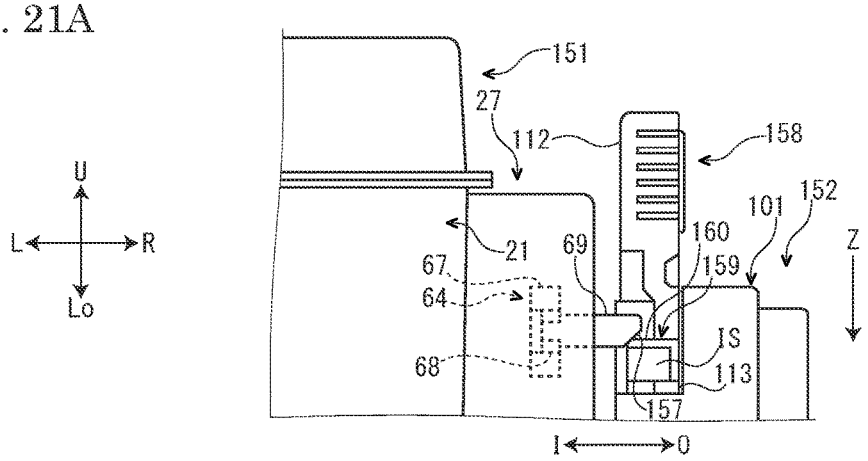
FIG. 21A is a front view showing a state where an inclined face of a boss part comes into contact with a pressing part of a protruding part, in the printer according to the second embodiment of the present disclosure.

When the worker sets the toner container 151 to the attachment part 152, the worker inserts the toner container 151 to the attachment part 152 along the attachment direction Z. As shown in FIG. 21A, when the toner container 151 is inserted to a predetermined position in the attachment part 152, the inclined face 157 of the boss part 69 of the holder 64 comes into contact with the pressing part 160 of the protruding part 159 of the manipulation member 158.

Figure 21B:
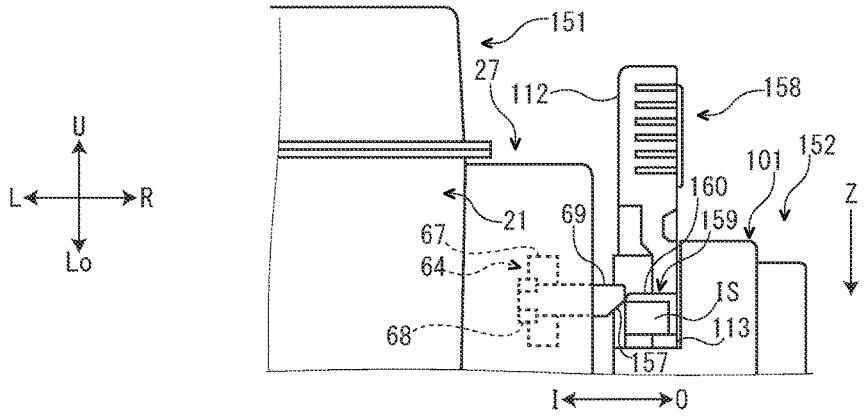
FIG. 21B is a front view showing a state where the pressing part of the protruding part presses the boss part to a left side, in the printer according to the second embodiment of the present disclosure.

From this state, the worker further inserts the toner container 151 to the attachment part 152 along the attachment direction Z, the pressing part 160 of the protruding part 159 presses the inclined face 157 of the boss part 69 to the left side (the inside in the left-and-right direction). Consequently, as shown in FIG. 21B, the arm part 68 of the holder 64 is elastically deformed to the left side (the inside in the left-and-right direction).

Figure 21C:
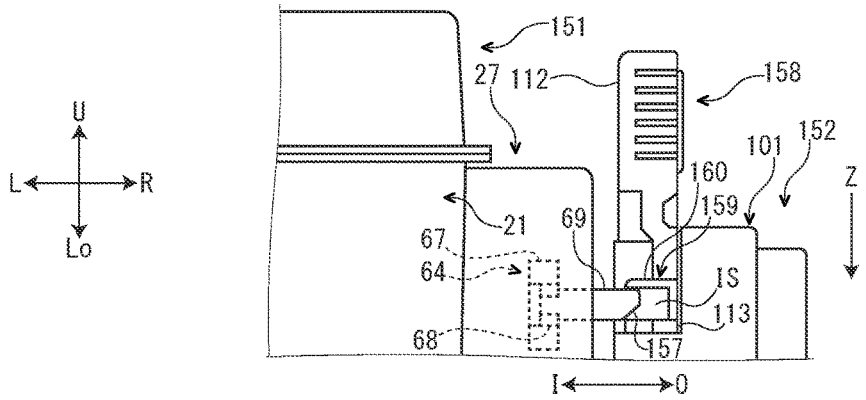
FIG. 21C is a front view showing a state where pressing of the boss part to the left side by the pressing part of the protruding part is released, in the printer according to the second embodiment of the present disclosure.
Figure 22:
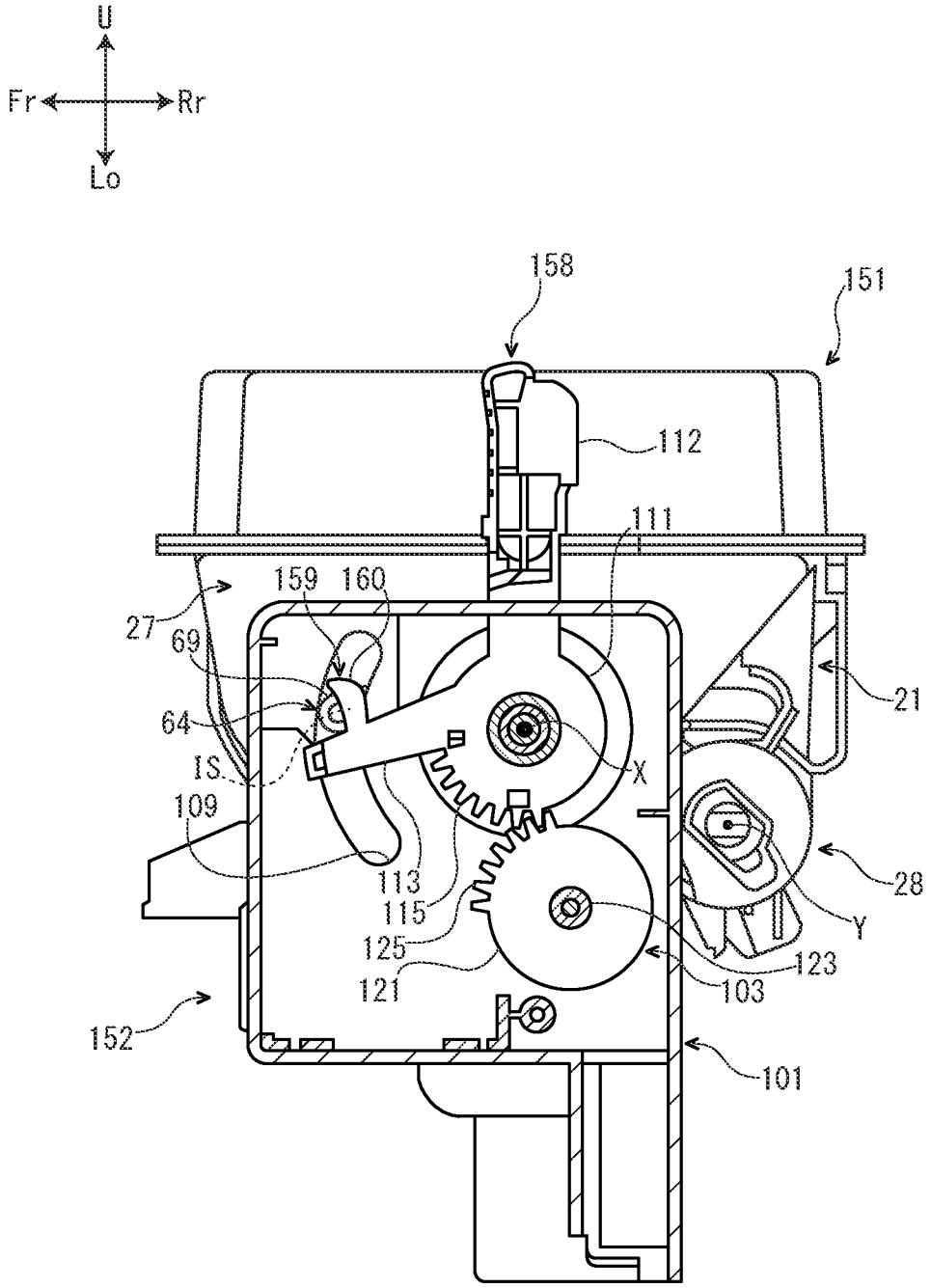
FIG. 22 is a sectional view showing a state where the toner container is attached to the attachment part and the manipulation member is in the first manipulating position, in the printer according to the second embodiment of the present disclosure.
Figure 23:
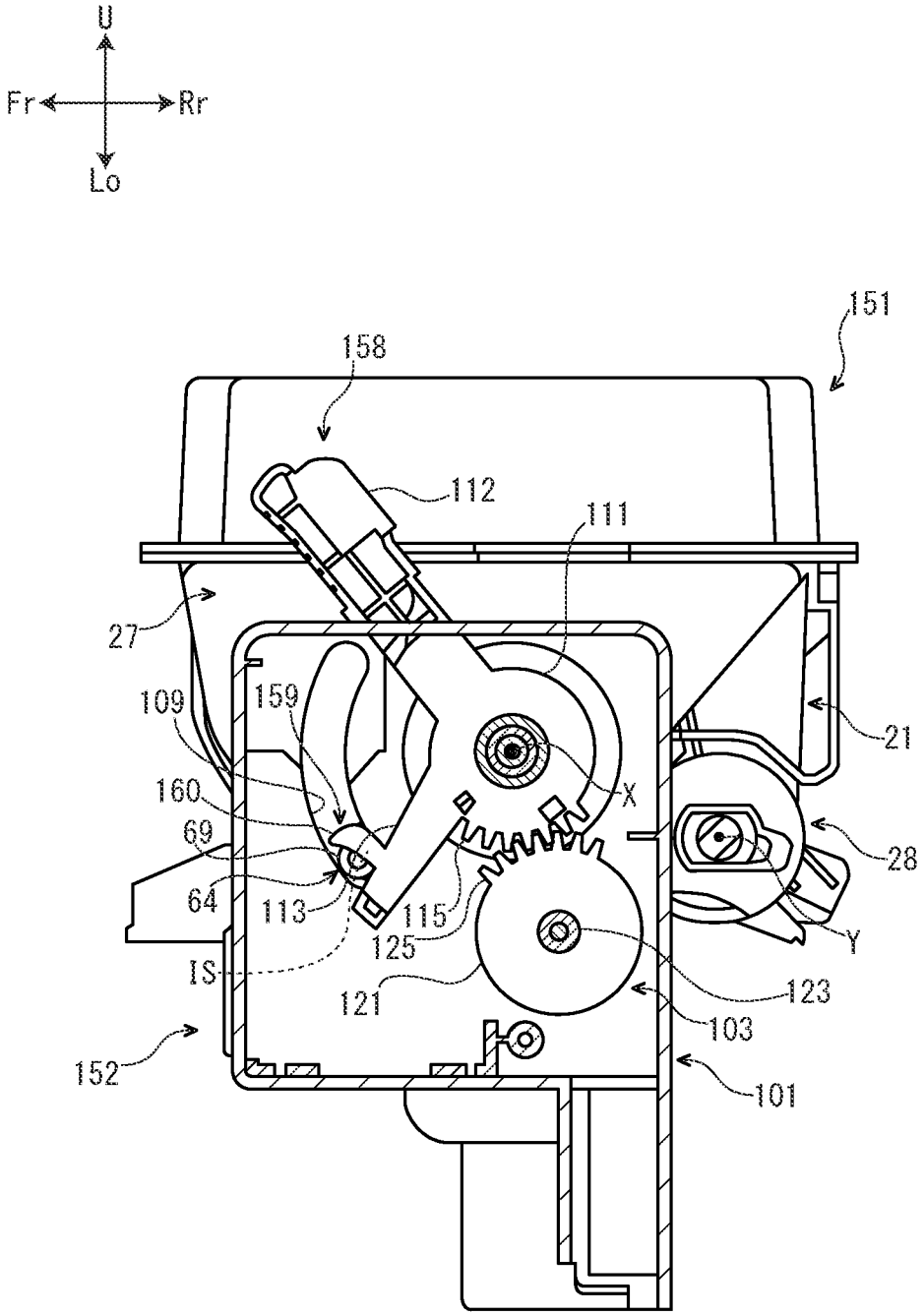
FIG. 23 is a sectional view showing a state where the toner container is attached to the attachment part and the manipulation member is in the second manipulating position, in the printer according to the second embodiment of the present disclosure.
Figure 24:
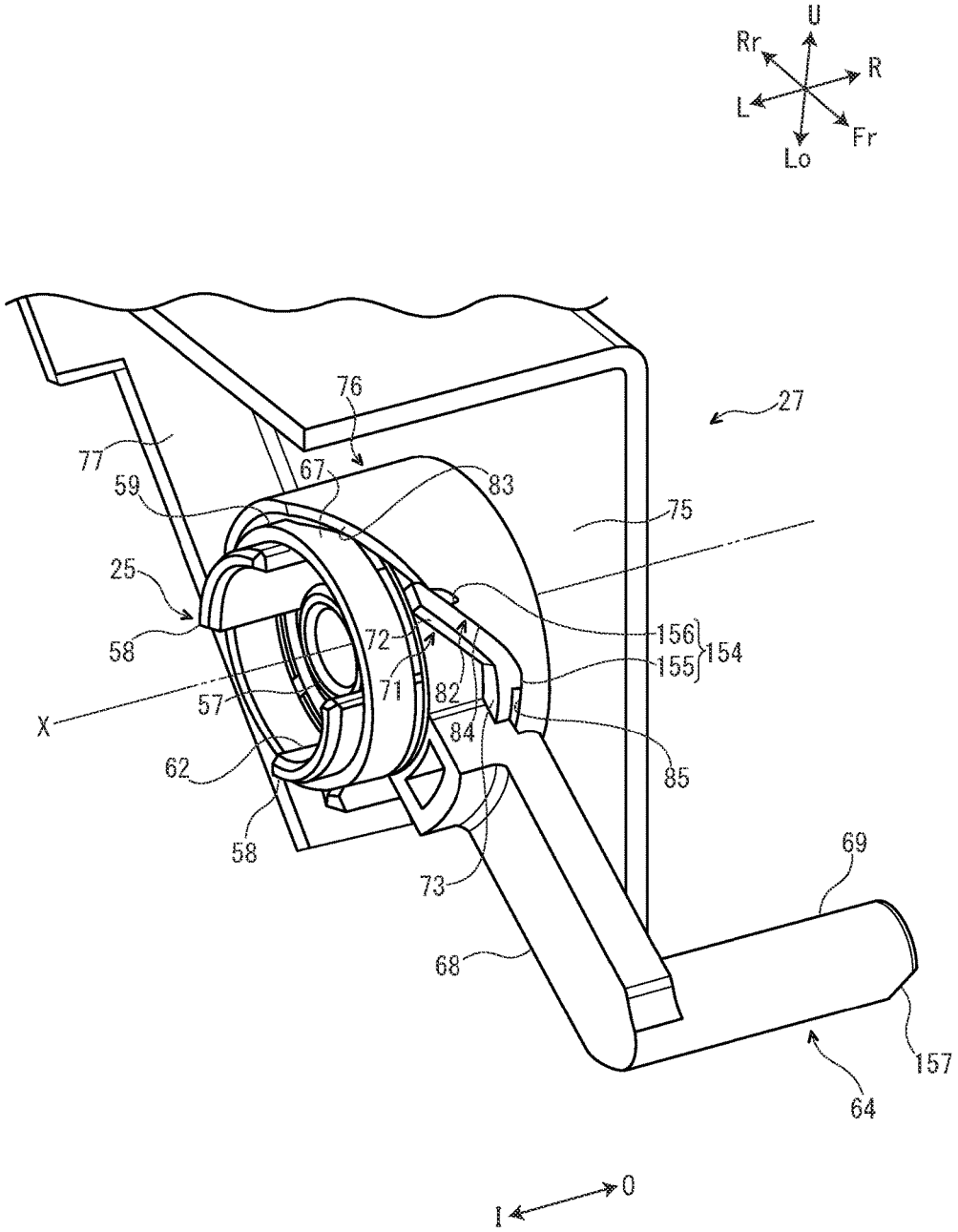
FIG. 24 is a perspective view showing a state where the holder is in the second holding position, in the toner container according to the second embodiment of the present disclosure.

From this state, the worker further inserts the toner container 151 to the attachment part 152 along the attachment direction Z, the toner container 151 is attached to the attachment part 152. Consequently, as shown in FIG. 21C, the pressing of the boss part 69 to the left side (the inside in the left-and-right direction) by the pressing part 160 of the protruding part 159 is released, the arm part 68 is elastically returned to the right side (the outside in the left-and-right direction) and the boss part 69 is arranged at the lower side (the downstream side in the attachment direction Z) of the pressing part 160 of the protruding part 159. As a result, the boss part 69 is inserted into the insertion space IS of the protruding part 159.

Next, the worker presses the manipulated part 112 of the manipulation member 158 to the front side. The pressing rotates the manipulation member 158 from the first manipulating position (refer to FIG. 22) to the second manipulating position (refer to FIG. 23), and the pressing part 160 of the protruding part 159 presses the boss part 69 to the lower side. Consequently, the engagement of each first projection 155 and each second projection 156 of the locking mechanism 154 is released. That is, the holding of the holder 64 in the first holding position by the locking mechanism 154 is released. Consequently, the holder 64 rotates from the first holding position (refer to FIG. 20) to the second holding position (refer to FIG. 24) by the biasing force of the coil spring 65. Consequently, the holder 64 moves to the right side (the outside in the left-and-right direction), and the transmitter 25 held by the holder 64 moves from the first position to the second position. As a result, the transmitting coupling 61 of the transmitter 25 protrudes to the right side (the outside in the left-and-right direction) further than the through hole 79 of the cover 27, and is coupled to the driving coupling 104.

When the toner container 151 is detached from the attachment part 152, the toner container 151 is pulled out from the attachment part 152 along a direction opposite to the attachment direction Z while inclining the toner container 151 its left side (the side to which the holder 64 is not provided) up and its right side (the side to which the holder 64 is provided) down. Thereby, it becomes possible to inhibit interference of the boss part 69 with the protruding part 159 and to detach the toner container 151 from the attachment part 152 smoothly.

In the present embodiment, as described above, the toner container 151 includes the locking mechanism 154 which holds the holder 64 in the first holding position against the biasing force of the coil spring 65. Thereby, in the state where the toner container 151 is detached from the attachment part 152, it becomes possible to hold the transmitter 25 in the first position by the holder 64 and to retract the transmitting coupling 61 of the transmitter 25 to the inside of the through hole 79 of the cover 27. Accordingly, it becomes possible to suppress the transmitting coupling 61 from being damaged by impact applied from the outside at transporting of the toner container 151.

The locking mechanism 154 includes the first projection 155 provided in the holder 64 and the second projection 156 provided in the cover 27, and the first projection 155 and the second projection 156 are engaged with each other. By applying such a configuration, it becomes possible to constitute the locking mechanism 154 without adding dedicated members.

Additionally, in a middle of attachment of the toner container 151 to the attachment part 152, the pressing part 160 of the protruding part 159 presses the boss part 69 to the left side (the inside in the left-and-right direction), and the arm part 68 is elastically deformed to the left side (the inside in the left-and-right direction). When the toner container 151 is attached to the attachment part 152, the pressing of the boss part 69 to the left side (the inside in the left-and-right direction) by the pressing part 160 of the protruding part 159 is released, the arm part 68 is elastically returned to the right side (the outside in the left-and-right direction), and the boss part 69 is arranged at the lower side (the downstream side in the attachment direction Z) of the pressing part 160 of the protruding part 159. By applying such a configuration, it becomes possible to press the boss part 69 by the pressing part 160 of the protruding part 159 surely as the manipulation member 158 rotates.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a toner case; and an attachment part to which the toner case is detachably attached, wherein the toner case includes:

a case main body storing a toner;

a rotator rotating around a rotation axis, at least a part of the rotator being stored in the case main body;

a transmitter arranged outside the case main body, having a transmitting coupling and transmitting rotation to the rotator; and a moving mechanism which moves the transmitter between a first position and a second position which is arranged at an outside of the first position in a rotation axis direction of the rotator, the attachment part includes:

a manipulation member moving between a first manipulating position and a second manipulating position; and a driving coupling rotated by rotation driving force from a driving source, wherein as the toner case is attached to the attachment part, the moving mechanism engages with the manipulation member and the transmitting coupling faces the driving coupling, and as the manipulation member moves from the first manipulating position to the second manipulating position in a state where the toner case is attached to the attachment part, the moving mechanism moves the transmitter from the first position to the second position and the transmitting coupling is coupled to the driving coupling.

2. The image forming apparatus according to claim 1, wherein the moving mechanism includes:

a holder rotating between a first holding position where the holder holds the transmitter in the first position and a second holding position where the holder holds the transmitter in the second position; and a biasing member biasing the holder to the second holding position, wherein as the toner case is attached to the attachment part, the manipulation member presses the holder and the holder rotates from the second holding position to the first holding position against biasing force of the biasing member, and as the manipulation member moves from the first manipulating position to the second manipulating position in the state where the toner case is attached to the attachment part, pressing of the holder in the first holding position by the manipulation member is released and the holder rotates from the first holding position to the second holding position by the biasing force of the biasing member.

3. The image forming apparatus according to claim 2, wherein the toner case further includes a cover covering an outside of the case main body in the rotation axis direction, and the cover includes:

a main wall having a through hole; and a guide wall protruding from the main wall at an outer circumference of the through hole to an inside in the rotation axis direction, wherein a part of the holder is inserted into the guide wall.

4. The image forming apparatus according to claim 3, wherein a guide part is formed on an edge of the guide wall at the inside in the rotation axis direction, at least a part of the guide part is inclined to an outside in the rotation axis direction from an upstream side to a downstream side in a rotating direction of the holder from the first holding position to the second holding position, and the holder includes a guided part which comes into contact with the part of the guide part.

5. The image forming apparatus according to claim 2, wherein the toner case further includes a supporter connected to the rotator, the transmitter is supported by the supporter in a state where the transmitter is movable in the rotation axis direction and is not rotatable with respect to the supporter, and the biasing member is interposed between the supporter and the transmitter.

6. The image forming apparatus according to claim 1, wherein the moving mechanism includes:

a holder rotating between a first holding position where the holder holds the transmitter in the first position and a second holding position where the holder holds the transmitter in the second position;

a biasing member biasing the holder to the second holding position; and a locking mechanism holding the holder in the first holding position against biasing force of the biasing member, wherein as the manipulation member moves from the first manipulating position to the second manipulating position in the state where the toner case is attached to the attachment part, the manipulation member presses the holder, holding of the holder in the first holding position by the locking mechanism is released and the holder rotates from the first holding position to the second holding position by the biasing force of the biasing member.

7. The image forming apparatus according to claim 6, wherein the toner case further includes a cover covering an outside of the case main body in the rotation axis direction, the locking mechanism includes:

a first projection provided on one of the holder and the cover; and a second projection provided on another of the holder and the cover, and engaging with the first projection.

8. The image forming apparatus according to claim 6, wherein the toner case is attached to the attachment part along an attachment direction, the holder includes:

a base part holding the transmitter;

an arm part extending from an outer circumferential face of the base part to an outside in a radial direction; and a boss part extending from the arm part to an outside in the rotation axis direction, and the manipulation member includes a pressing part which presses the boss part as the manipulation member moves from the first manipulating position to the second manipulating position, wherein in a middle of attaching the toner case to the attachment part, the pressing part presses the boss part to an inside in the rotation axis direction and the arm part is elastically deformed to the inside in the rotation axis direction, and when the toner case is attached to the attachment part, pressing of the boss part to the inside in the rotation axis direction by the pressing part is released, the arm part is elastically returned to the outside in the rotation axis direction and the boss part is arranged at a downstream side of the pressing part in the attachment direction.

9. The image forming apparatus according to claim 1, wherein the case main body has a discharge port through which the toner is discharged, the toner case further includes a shutter rotating between a closing position where the shutter closes the discharge port and an opening position where the shutter opens the discharge port, the manipulation member rotates between the first manipulating position and the second manipulating position, and as the manipulation member rotates from the first manipulating position to the second manipulating position, rotation of the manipulation member is transmitted to the shutter and the shutter rotates from the closing position to the opening position.

10. The image forming apparatus according to claim 9, wherein the attachment part further includes a connector connected to the manipulation member, and as the toner case is attached to the attachment part, the manipulation member is connected to the shutter via the connector.

11. The image forming apparatus according to claim 1, wherein the toner case further includes a cover covering an outside of the case main body in the rotation axis direction, an entire portion of the transmitter is retracted to an inside of the cover in a state where the transmitter is in the first position, and the transmitting coupling protrudes to an outside further than the cover in the rotation axis direction in a state where the transmitter is in the second position.

12. The image forming apparatus according to claim 1, wherein the transmitter moves linearly along the rotation axis direction between the first position and the second position.

13. A toner case detachably attached to an attachment part of an image forming apparatus, the toner case comprising:

a case main body storing a toner;

a rotator rotating around a rotation axis, at least a part of the rotator being stored in the case main body;

a transmitter arranged outside the case main body, having a transmitting coupling and transmitting rotation to the rotator; and a moving mechanism which moves the transmitter between a first position and a second position which is arranged at an outside of the first position in a rotation axis direction of the rotator, the attachment part includes:

a manipulation member moving between a first manipulating position and a second manipulating position; and a driving coupling rotated by rotation driving force from a driving source, wherein as the toner case is attached to the attachment part, the moving mechanism engages with the manipulation member and the transmitting coupling faces the driving coupling, and as the manipulation member moves from the first manipulating position to the second manipulating position in a state where the toner case is attached to the attachment part, the moving mechanism moves the transmitter from the first position to the second position and the transmitting coupling is coupled to the driving coupling.

* * * * *